US007791284B2

(12) United States Patent
Otsuki et al.

(10) Patent No.: US 7,791,284 B2
(45) Date of Patent: Sep. 7, 2010

(54) COLD CATHODE TUBE DRIVE DEVICE

(75) Inventors: Tadashi Otsuki, Tokyo (JP); Toru Takahara, Tokyo (JP); Akio Niekawa, Tokyo (JP)

(73) Assignee: Sumida Corporation (JP)

( * ) Notice: Subject to any disclaimer, the term of this patent is extended or adjusted under 35 U.S.C. 154(b) by 658 days.

(21) Appl. No.: 11/664,895

(22) PCT Filed: Aug. 8, 2005

(86) PCT No.: PCT/JP2005/018417

§ 371 (c)(1),
(2), (4) Date: Apr. 6, 2007

(87) PCT Pub. No.: WO2006/040968

PCT Pub. Date: Apr. 20, 2006

(65) Prior Publication Data

US 2009/0001898 A1 Jan. 1, 2009

(30) Foreign Application Priority Data

Oct. 8, 2004 (JP) ..... 2004-295571

(51) Int. Cl.
*H05B 41/36* (2006.01)

(52) U.S. Cl. ..... 315/226; 315/209; 315/360

(58) Field of Classification Search ..... 315/137, 315/138, 140, 141, 142, 144, 146, 177, 185 R, 315/186, 189, 193, 209 R, 210, 211, 212, 315/216, 224, 225, 226, 209 T, 291–311, 315/312, 313, 320, 323, 360, 362
See application file for complete search history.

(56) References Cited

U.S. PATENT DOCUMENTS

2002/0125835 A1 9/2002 Ito et al.

FOREIGN PATENT DOCUMENTS

| | | |
|---|---|---|
| JP | 8-308237 | 11/1996 |
| JP | 2575625 | 11/1996 |
| JP | 6-203983 | 7/2001 |
| JP | 2001-235720 | 8/2001 |
| JP | 2002-246195 | 8/2002 |
| JP | 2002-352974 | 12/2002 |

*Primary Examiner*—Douglas W Owens
*Assistant Examiner*—Jianzi Chen
(74) *Attorney, Agent, or Firm*—von Simson & Chin

(57) ABSTRACT

A cold-cathode tube driving apparatus wherein the number of booster transformers has been reduced and the increase in installation space and in cost has been suppressed. This cold-cathode tube driving apparatus comprises a booster transformer (2); a plurality of cold-cathode tubes (3-1 to 3-N); and a time division control circuit (control circuit 6 and time division FETs 4-1 to 4-N) for lighting one or more of the plurality of cold-cathode tubes (3-1 to 3-N) in a time division manner by use of a high frequency voltage after boosted by the booster transformer (2).

6 Claims, 12 Drawing Sheets

--PRIOR ART --

COLD CATHODE TUBE DRIVE DEVICE

CROSS REFERENCES TO RELATED APPLICATIONS

This application claims priority to international application number PCT/JP 2005/018417 filed on Aug. 8, 2005 which claims priority to Japanese patent application number 2004-295571 filed on Oct. 8, 2004, the entire disclosures of which are hereby incorporated by reference.

TECHNICAL FIELD

The present invention relates to a cold-cathode tube driving apparatus.

BACKGROUND ART

Conventionally, a plurality of cold-cathode tubes (CCFLs: Cold Cathode Fluorescent Lamps) are used for a backlight of a liquid crystal display in a liquid crystal television receiver (hereinafter referred to as a "liquid crystal TV"), a liquid crystal monitor, or the like (see, for example, Japanese Patent Application Laid-Open No. 2004-213994 (FIG. 1) (Patent document 1)). For example, in the liquid crystal TV having a screen size of about 30 inches, about 14 to 16 pieces of cold-cathode tubes are used.

FIG. 12 is a circuit diagram showing a conventional cold-cathode tube driving apparatus. In an apparatus shown in FIG. 12, N (N>1) pieces of cold-cathode tubes 104-1 to 104-N are provided. An inverter circuit 101 generates a high frequency voltage and N pieces of booster transformers 103-1 to 103-N boost the high frequency voltage generated by the inverter circuit 101 to apply the high frequency voltage after boosted to the N pieces of cold-cathode tubes 104-1 to 104-N. Note that the inverter circuit 101 detects conduction current values of the cold-cathode tubes 104-1 to 104-N based on drop voltages by resistances 105-1 to 105-N to supply gate signals in accordance with the values to current control FETs 102-1 to 102-N to thereby control the conduction current of the cold-cathode tubes 104-1 to 104-N. The current control FETs 102-1 to 102-N control the amount of the current conducted in the cold-cathode tubes 104-1 to 104-N in accordance with the gate signals from the inverter circuit 101.

In this manner, the N pieces of cold-cathode tubes 104-1 to 104-N are driven by the N pieces of booster transformers 103-1 to 103-N.

Patent document 1: Japanese Patent Application Laid-Open No. 2004-213994 (FIG. 1).

DISCLOSURE OF THE INVENTION

Problems to be Resolved by the Invention

As described above, in the conventional cold-cathode tube driving apparatus, the same number of booster transformers 103-1 to 103-N as the number N of the cold-cathode tubes 104-1 to 104-N are provided, therefore, when the plurality of cold-cathode tubes are provided, the installation space for the cold-cathode tube driving apparatus is increased in a chassis of a device having the liquid crystal display to thereby increase the cost of the cold-cathode tube driving apparatus as well, causing a problem.

Also, a method, in which a single booster transformer drives a plurality of cold-cathode tubes connected in parallel at a time, was developed, however, in that case, a ballast capacitor is needed to be inserted in series into the respective tubes for the purpose of equalizing the conduction current values of the plurality of tubes connected in parallel; accordingly, the consumption power for that purpose increases to thereby increase the conduction current (output power) of the booster transformer and the booster transformer is therefore required to use a wiring (especially, a primary wiring) having a large diameter, so that the booster transformer is caused to increase in size as well as in weight.

The present invention has been made in consideration of the above-described problem, and an object thereof is to obtain a cold-cathode tube driving apparatus capable of reducing the number of booster transformers to suppress an increase in installation space and in cost. Further, as will be stated in the detailed description, by performing a time division control, a stable control to each tube can be realized.

Means for Solving the Problems

In order to bring a solution to the above-described problems, the present invention is as described below.

The cold-cathode tube driving apparatus according to the present invention includes: a booster transformer, a plurality of cold-cathode tubes, and a time division control circuit for lighting one or more of the plurality of cold-cathode tubes in a time division manner by use of a high frequency voltage after boosted by the booster transformer.

With this, the plurality of cold-cathode tubes are driven by the single booster transformer, so that the increase in installation space and in cost can be suppressed as compared to the case where the booster transformer is provided to each of the plurality of cold-cathode tubes.

Further, in addition to the above-described cold-cathode tube driving apparatus, the cold-cathode tube driving apparatus according to the present invention may be as follows. Specifically, the cold-cathode tube driving apparatus includes an inverter circuit generating the high frequency voltage at a predetermined cycle. The time division control circuit time-divides the cycle of high frequency voltage generated by the inverter circuit or the cycle of current supplied from the inverter circuit to the plurality of cold-cathode tubes into two or more periods, and lights one or more of the plurality of cold-cathode tubes for each respective time-divided period sequentially by use of the high frequency voltage outputted by the booster transformer.

With this, the above-described time division control can be realized by a simple circuit.

Further, in addition to any one of the above-described cold-cathode tube driving apparatuses, the cold-cathode tube driving apparatus according to the present invention may be as follows. The time division control circuit includes: a plurality of switching elements connected in series to the cold-cathode tubes and a control circuit generating a control signal to perform an ON/OFF control of the respective switching elements.

With this, the above-described time division control can be realized by a simple circuit.

Further, in addition to the above cold-cathode tube driving apparatuses, the cold-cathode tube driving apparatus according to the present invention includes a plurality of resistance elements connected in parallel to between the switching elements and a ground.

With this, by flowing bias current more than kick-off current, the cold-cathode tubes can be driven smoothly with a lower consumption power.

Further, in addition to any one of the above-described cold-cathode tube driving apparatuses, the cold-cathode tube driving apparatus according to the present invention includes a plurality of resistance elements connected in series to between the switching elements and the ground, in which the control circuit performs the ON/OFF control of the respective switching elements in accordance with a voltage generated at the plurality of resistance elements.

With this, the current flowing in each cold-cathode tube can be known, allowing controlling the current to have a predetermined value for each cold-cathode tube. With this, luminance unevenness can be eliminated.

Further, in addition to any one of the above-described cold-cathode tube driving apparatuses, the cold-cathode tube driving apparatus according to the present invention includes a resistance element connected in series to between the switching elements and a ground, in which the control circuit performs the ON/OFF control to the respective switching elements in accordance with a voltage generated at the resistance element.

With this, the current supplied from the booster transformer to the respective cold-cathode tubes can be known, so that the luminance unevenness of the cold-cathode tube can be eliminated. Further, it is possible to know the leak current in the respective cold-cathode tubes when the detection is performed together with the plurality of resistance elements connected to between the switching elements and the ground, so that the respective cold-cathode tube can be controlled more precisely.

Further, in addition to any one of the above-described cold-cathode tube driving apparatuses, the cold-cathode tube driving apparatus according to the present invention is the cold-cathode tube driving apparatus, in which the control circuit performs the ON/OFF control of the respective switching circuits in accordance with an average value of the voltage generated at the resistance element(s) in a period of one cycle or more of the high frequency voltage outputted by the inverter circuit.

With this, the circuit can be prevented from resonating due to a rapid control, so that the cold-cathode tube can be controlled stably.

Further, in addition to the above cold-cathode tube driving apparatus, the cold-cathode tube driving apparatus according to the present invention is the cold-cathode tube driving apparatus, in which the control circuit holds count values corresponding to target current being the current targeted to flow in the respective cold-cathode tubes, selects a maximum count value to light the corresponding cold-cathode tube, and subtracts a predetermined value thereafter, and when the count value results in a predetermined value or less, the count value is deleted to repeat a same process with respect to remaining count values.

With this, it is possible to control the current flowing in the respective cold-cathode tubes to have a desired current value based on a simple configuration.

Further, in addition to the above cold-cathode tube driving apparatus, the cold-cathode tube driving apparatus according to the present invention is the cold-cathode tube driving apparatus, in which the control circuit holds count values corresponding to target frequencies being drive frequencies targeted by the respective cold-cathode tubes, selects a maximum count value to light the corresponding cold-cathode tube, and subtracts a predetermined value thereafter, and when the count value results in a predetermined value or less, the count value is deleted to repeat a same process with respect to remaining count values.

With this, it is possible to control the drive frequency in the respective cold-cathode tubes to be a desired frequency based on a simple configuration.

EFFECT OF THE INVENTION

According to the present invention, for the cold-cathode tube driving apparatus, the number of the booster transformers can be reduced, and thereby the increase in the installation space and in the cost can be suppressed.

EXPLANATION OF NUMERALS AND SYMBOLS

1. inverter circuit

2. booster transformer

3. -1 to 3-N, 3-1*a* to 3-Na, 3-1*b* to 3-Nb, 3-1*c* to 3-Nc cold-cathode tubes

4. -4-1 to 4-N, 4-1*a* to 4-Na, 4-1*b* to 4-Nb, 4-1*c* to 4-Nc time division FETs (parts of time division control circuit, switching elements)

6. control circuit (a part of time division control circuit, a control circuit)

23. resistance (resistance element)

24. -1 to 24-N resistances (resistance elements)

BEST MODE FOR CARRYING OUT THE INVENTION

Hereinafter, modes according to the present invention will be described based on the drawings.

Mode 1

Figure 1:
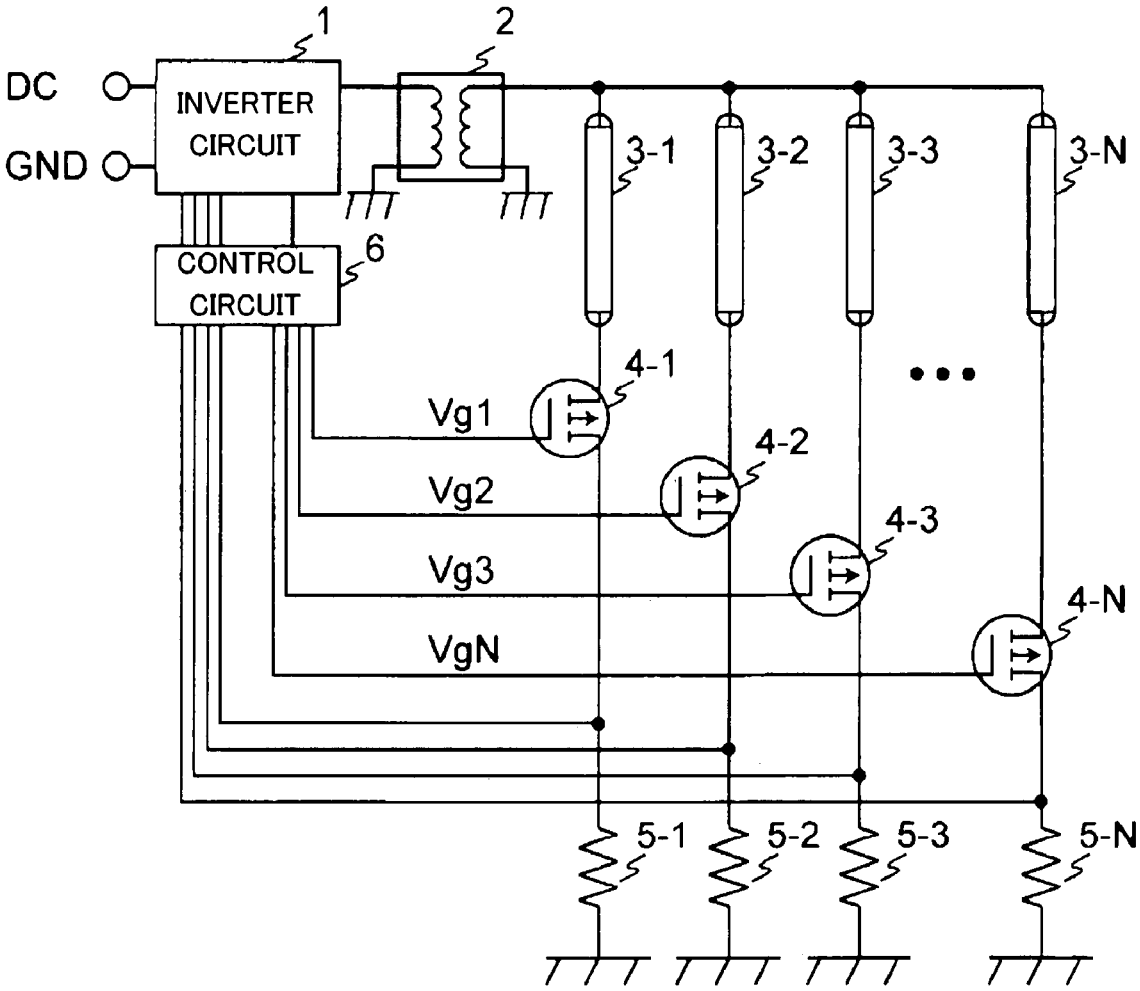
FIG. 1 is a circuit diagram showing a configuration of a cold-cathode tube driving apparatus according to an embodiment 1 of the present invention.

FIG. 1 is a circuit diagram showing a configuration of a cold-cathode tube driving apparatus according to a mode 1 of the present invention. In FIG. 1, an inverter circuit 1 is a circuit connected to a DC power source to generate a high frequency voltage at a predetermined cycle. A booster transformer 2 is a transformer boosting the high frequency voltage generated by the inverter circuit 1.

Further, cold-cathode tubes 3-1 to 3-N are a plurality of cold-cathode tubes (CCFLs) with their one ends being connected to one end of a secondary wiring of the booster transformer 2 and their other ends being connected to time division FETs 4-1 to 4-N, respectively. The cold-cathode tubes 3-*i* is a discharge tube being a tube in which electrons traveling between both electrodes clash with an enclosed gas and the like to emit fluorescence.

Further, time division FETs 4-1 to 4-N are a plurality of switching elements connected in series to the cold-cathode tubes 3-1 to 3-N, respectively. The time division FETs 4-1 to 4-N are connected to the low voltage sides of the cold-cathode tubes 3-1 to 3-N, respectively. Note that although the time division FETs 4-1 to 4-N are FETs (field-effect transistors), bipolar transistors may be used instead.

Further, resistances 5-1 to 5-N are connected in series to the cold-cathode tubes 3-1 to 3-N, respectively, and are resistance elements to detect the conduction current respectively of the cold-cathode tubes 3-1 to 3-N.

Further, a control circuit 6 is a circuit generating a control signal to perform an ON/OFF control of the time division FET 4-i (i=1 to 4), which time divides the high frequency voltage after boosted by the booster transformer 2 to apply the time-divided high frequency voltage to the plurality of cold-cathode tubes 3-1 to 3-N sequentially on an one-by-one basis for each cold-cathode tube 3*i*.

Further, the control circuit 6 time divides the cycle of the high frequency voltage generated by the inverter circuit 1, or the cycle of the current supplied from the inverter circuit 1 to the plurality of cold-cathode tubes 3-1 to 3-N into two or more, and a period of time-divided high frequency voltage is applied to the plurality of cold-cathode tubes 3-1 to 3-N on an one-by-one basis.

Note that the time division FETs 4-1 to 4-N and the control circuit 6 serve as a time-division control circuit lighting one or more of the plurality of cold-cathode tubes 3-1 to 3-N in a time division manner by use of the high frequency voltage after boosted by the booster transformer 2.

Figure 2:
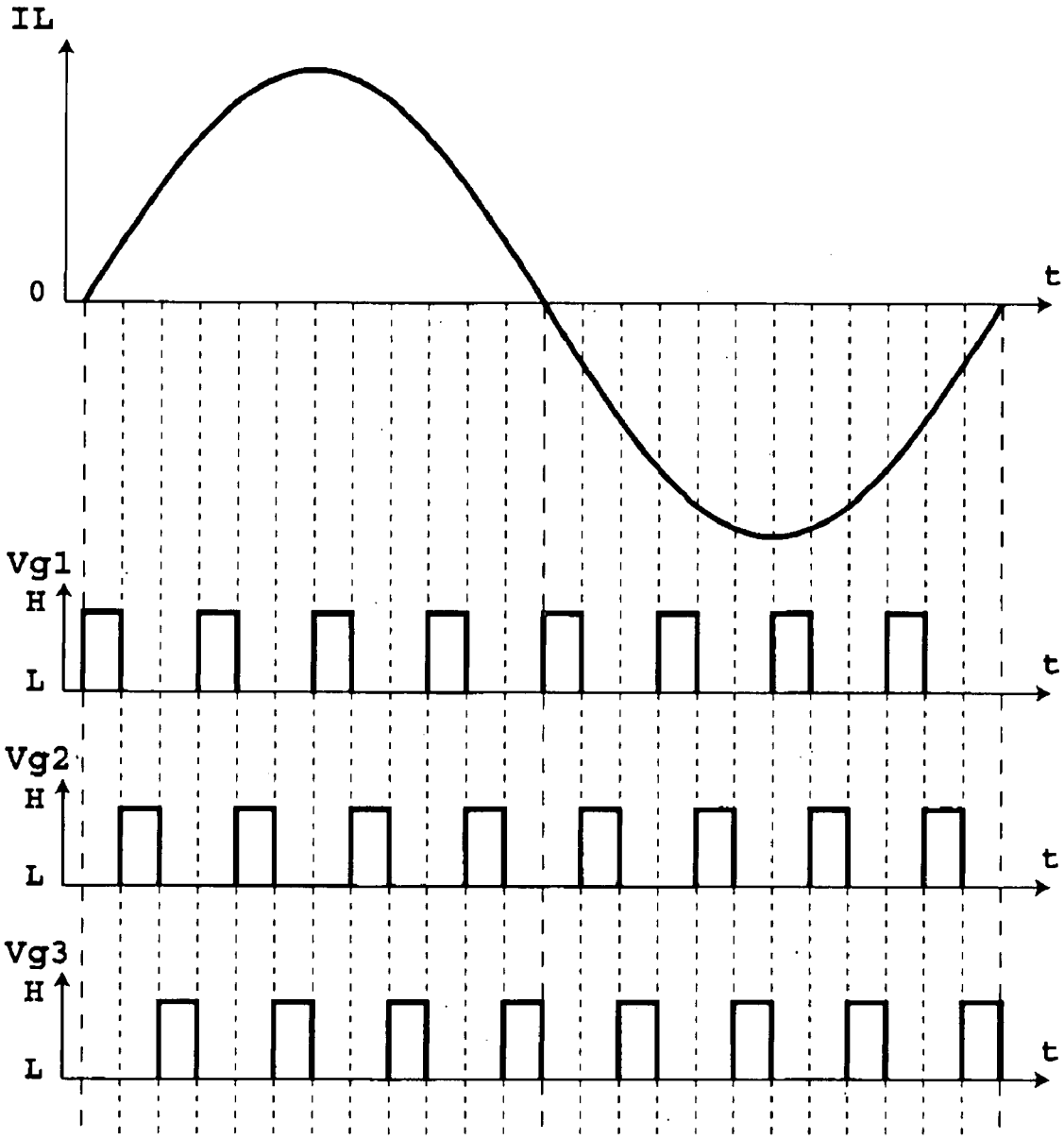
FIG. 2 is a view illustrating a time division control by the cold-cathode tube driving apparatus according to the embodiment 1.

Subsequently, the description will be given of the operation of the above-described apparatus. FIG. 2 is a view illustrating a time division control by the cold-cathode tube driving apparatus according to the mode 1.

The inverter circuit 1 generates a high frequency voltage at a predetermined frequency and applies the frequency to a primary wiring of the booster transformer 2. Further, the inverter circuit 1 detects a lamp current based on a drop voltage by the resistances 5-1 to 5-N after starting its operation, and adjusts the output based thereon.

The booster transformer 2 boosts the high frequency voltage generated by the inverter circuit 1. The voltage induced to the secondary wiring of the booster transformer 2 is applied in parallel to the N (i=1 to N) pieces of series circuits each composed by the cold-cathode tube 3-*i*, the time division FET 4-*i* and the resistances 5-*i*.

At this time, the control circuit 6 generates a gate signal for the time division FETs 4-1 to 4-N at a predetermined time-series pattern and repeats the generation at the cycle shorter than the cycle of the lamp current being based on output voltage or output current of the inverter circuit 1 or the drop voltage by the resistances 5-1 to 5-N (namely, a secondary-side current of the booster transformer 2) to thereby turn on the time division FETs 4-1 to 4-N for a predetermined period only sequentially on an one-by-one basis.

In the period where the time division FET 4-*i* is in the "on" state, the. high frequency voltage boosted by the booster transformer 2 is applied to almost both ends of the cold-cathode tube 3-*i*. Accordingly, under the control of the control circuit 6, the cold-cathode tubes 3-1 to 3-N are lighted sequentially on an one-by-one basis at the cycle shorter than the cycle of the output voltage or output current of the inverter circuit 1.

For instance, when the cold-cathode tubes 3-1 to 3-N are three pieces (N=3), as shown in FIG. 2, the control circuit 6 generates gate signals Vgj (j=1, 2, 3) reaching a high-level at the cycle (a quarter cycle in FIG. 2) shorter than the cycle of a lamp current IL (the secondary-side current of the booster transformer 2), and applies the gate signals to between the gates and sources of the time division FETs 4-1 to 4-3 to turn on the time division FETs 4-1 to 4-3 for the predetermined period only sequentially on an one-by-one basis.

At this time, the control circuit 6 generates the gate signal vgj in a synchronized manner, for example, with the output voltage, output current, lamp current IL and so on of the inverter circuit 1. The gate signal vgi becomes the high level only for a period of one third of the cycle (=1/N). The three (N=3) gate signals Vgj are deviated by 120 degrees (=360/N) from each other in phase.

With this, the three cold-cathode tubes 3-1 to 3-N are lighted in the order of the cold-cathode tube 3-1, cold-cathode tube 3-2, cold-cathode tube 3-3, cold-cathode tube 3-1, cold-cathode tube 3-2, cold-cathode tube 3-3 . . . , repeatedly. When focusing on the single cold-cathode tube 3-*j*, it is blinking at the cycle of the gate signal Vgj, however, in the period where the cold-cathode tube 3-*j* is lighted out, the other cold-cathode tube 3-*k* (k=1, 2, 3, provided k≠j) is lighted. Note that the cycle for a certain cold-cathode tube 3-*j* from a lighting to the next lighting is sufficiently short and the cold-cathode tube 3-*j* is lighted twice or more in one cycle of the lamp current, so that it is visually seemed to be lighted (emit light) continuously.

As described above, the cold-cathode tube driving apparatus according to the mode 1 includes the booster transformer 2, the plurality of cold-cathode tubes 3-1 to 3-N, and the control circuit 6 time dividing the high frequency voltage boosted by the booster transformer 2 to apply the time-divided voltage to the plurality of cold-cathode tubes 3-1 to 3-N sequentially on an one-by-one basis.

With this, the plurality of cold-cathode tubes 3-1 to 3-N are driven by the single booster transformer 2, so that the number of the booster transformers can be reduced and thereby the increase in installation space and in cost can be suppressed as compared to the case where one booster transformer is provided to each of the plurality of cold-cathode tubes.

Further, according to above-described the mode 1, the control circuit 6 time divides the cycle of high frequency voltage generated by the inverter circuit 1 or the cycle of current supplied from the inverter circuit 1 to the plurality of cold-cathode tubes 3-1 to 3-N into two or more periods, and the high frequency voltage outputted from the booster transformer 2 is applied to each of the plurality of cold-cathode tubes 3-1 to 3-N for the time-divided period on an one-by-one basis. Above all, in the mode 1, the time division FETs 4-1 to 4-N are connected in series to the cold-cathode tubes 3-1 to 3-N, respectively, and the control circuit 6 generates the control signal to perform the ON/OFF control of the respective time division FETs 4-*i*.

With this, the above-described time division control can be realized by a simple circuit configuration.

Mode 2

A cold-cathode tube driving apparatus according to a mode 2 of the present invention is designed to switch lighting/lighting out of two cold-cathode tubes 3-*ia*, 3-*ib* by the single time division FET 4-*i* (i=1 to N).

Figure 3:
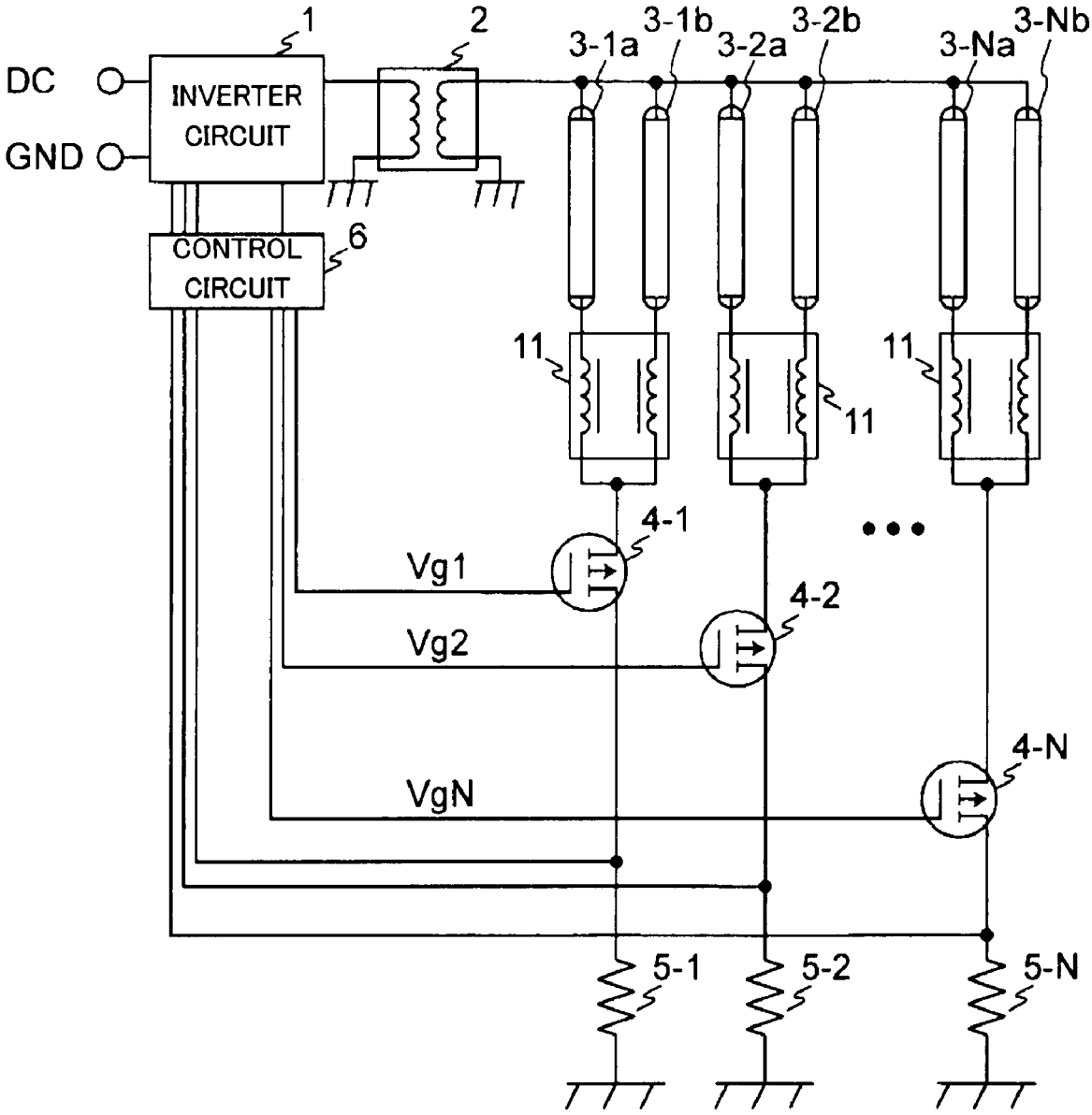
FIG. 3 is a circuit diagram showing a configuration of a cold-cathode tube driving apparatus according to an embodiment 2 of the present invention.

FIG. 3 is a circuit diagram showing a configuration of the cold-cathode tube driving apparatus according to the mode 2 of the present invention. In FIG. 3, a group is composed of two cold-cathode tubes, and N group of cold-cathode tubes (3-1*a*, 3-1*b*) to (3-Na, 3-Nb) are provided. The group of two cold-cathode tubes 3-*ia*, 3-*ib* (i=1 to N, N>1) are connected in parallel via a current balance circuit 11 and are lighted/lighted out at the same timing. Further, one ends of the respective groups of cold-cathode tubes 3-*ia*, 3-*ib* (i=1 to N) are connected to one end of the secondary wiring of the booster transformer 2 and the other ends are connected to the respective current balance circuits 11.

Further, the current balance circuit 11 is a circuit to balance the conduction current of two choke coils by magnetically coupling the two choke coils. The single current balance circuit 11 is connected to the group of cold-cathode tubes 3-*ia*, 3-*ib*. The one cold-cathode tubes 3-*ia* is connected in series to one of the choke coils of the current balance circuit 11 and the other cold-cathode tube 3-*ib* is connected in series to the other choke coil of the current balance circuit 11. Of the ends of the two choke coils of the current balance circuit 11, the ends to which the cold-cathode tubes 3-*ia*, 3-*ib* are not connected are connected to each other.

Further, the time division FETs 4-1 to 4-N are a plurality of switching elements connected in series to the groups of cold-cathode tubes (3-1*a*, 3-1*b*) to (3-Na, 3-Nb) and the current balance circuits 11, respectively.

Note that the other components in FIG. 3 are the same as in the mode 1 (FIG. 1), so that the description thereof will be omitted here.

Subsequently, the description will be given of the operation of the above-described apparatus.

In the mode 2, as in the mode 1, the high frequency voltage after boosted is applied to the series circuit composed of the cold-cathode tubes 3-*ia*, 3*ib*, the current balance circuit 11, the time division FET 4-*i* and the resistances 5-*i* (i=1 to N) by the inverter circuit 1 and the booster transformer 2. Further, in the same manner as in the mode 1, the gate signal Vgi is supplied to the respective time division FETs 4-*i* by the control circuit 6.

Accordingly, in the period where the time division FET 4-*i* is in the "on" state, the high frequency voltage after boosted by the booster transformer 2 is applied to both the ends of the cold-cathode tubes 3-*ia*, 3-*ib* to light the two cold-cathode tubes 3-*ia*, 3-*ib*. At that time, caused by the current balance circuit 11, the lamp current of the cold-cathode tube 3-*ia* and that of the cold-cathode tube 3-*ib* have substantially the same waveform, so that the cold-cathode tube 3-*ia* and the cold-cathode tube 3-*ib* emit the same amount of light, respectively.

Thus, in the period where the time division FET 4-*i* is in the "on" state, the group of two cold-cathode tubes 3-*ia*, 3-*ib* are lighted. Meanwhile, in the same manner as in the mode 1, the control circuit 6 repeatedly turns on the time division FETs 4-1 to 4-N for a predetermined period only sequentially on an one-by-one basis at the cycle shorter than the cycle of the lamp current being based on the output voltage or output current of the inverter circuit 1 or the drop voltages by the resistances 5-1 to 5-N. Accordingly, under the control by the control circuit 6, the groups of cold-cathode tubes (3-1*a*, 3-1*b*) to (3-Na, 3-Nb) are lighted sequentially on an one-group by one-group basis (by two cold-cathode tubes) repeatedly at the cycle shorter than the cycle of the output voltage or output current of the inverter circuit 1.

As described above, the cold-cathode tube driving apparatus according to the mode 2 includes the booster transformer 2, the plurality of cold-cathode tubes (3-1*a*, 3-1*b*) to (3-Na, 3-Nb), and the control circuit 6 time-dividing the high frequency voltage boosted by the booster transformer 2 to apply the time-divided voltage to the plurality of cold-cathode tubes (3-1*a*, 3-1*b*) to (3-Na, 3-Nb) sequentially on an one-group by one-group basis.

With this, the plurality of cold-cathode tubes (3-1*a*, 3-1*b*) to (3-Na, 3-Nb) are driven by the single booster transformer 2, so that the number of the booster transformers can be reduced and thereby the increase in the installation space and in the cost can be suppressed as compared to the case where the booster transformer is provided to each of the plurality of cold-cathode tubes. Further, the one switching element (time division FET 4-*i*) performs the lighting control of the two cold-cathode tubes 3-*ia*, 3-*ib*, so that the number of the switching elements (time division FETs 4-*i*), furthermore, the number of gate signals generated by the control circuit 6 and the number of wirings from the control circuit 6 to the switching elements can be reduced.

Mode 3

A cold-cathode tube driving apparatus according to a mode 3 of the present invention is designed to switch the lighting/lighting out of three cold-cathode tubes 3-*ia*, 3-*ib*, 3-*ic* by the single time division FET 4-*i* (i=1 to N).

Figure 4:
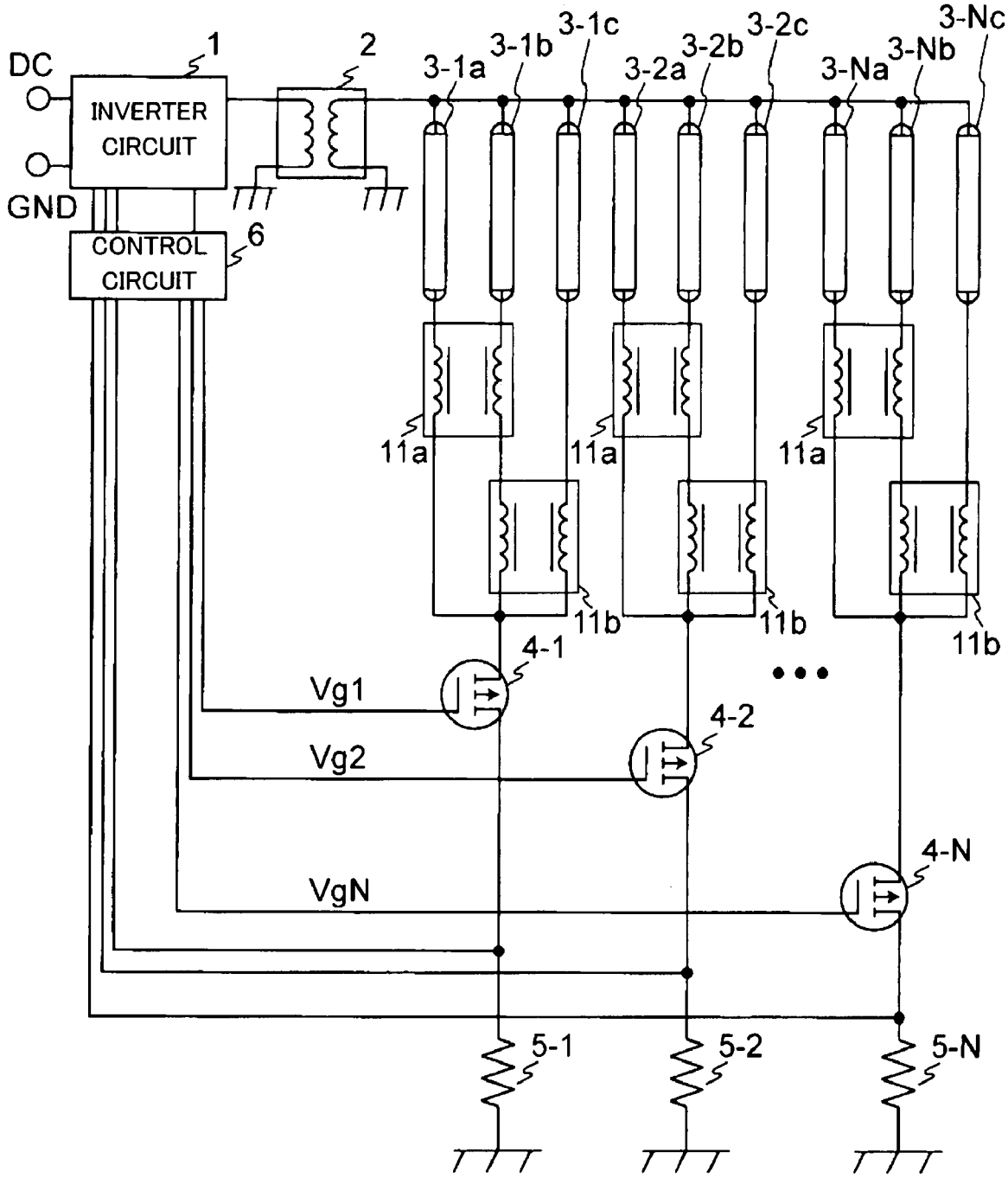
FIG. 4 is a circuit diagram showing a configuration of a cold-cathode tube driving apparatus according to an embodiment 3 of the present invention.

FIG. 4 is a circuit diagram showing a configuration of the cold-cathode tube driving apparatus according to the mode 3 of the present invention. In FIG. 4, N groups of the cold-cathode tubes, each composed of three cold-cathode tubes (3-1*a*, 3-1*b*, 3-1*c*) to (3-Na, 3-Nb, 3Nc) are provided. The three cold-cathode tubes 3-*ia*, 3-*ib*, 3-*ic* (i=1 to N, N>1) are connected in parallel via two current balance circuit 11*a*, 11*b* to be lighted/lighted out at the same timing. Further, one ends of each group of cold-cathode tubes 3-*ia*, 3-*ib*, 3-*ic* (i=1 to N) are connected to one end of the secondary wiring of the booster transformer 2 and the other ends are connected to the current balance circuits 11*a*, 11*b*.

Further, the current balance circuit 11*a*, 11*b* are the same circuits as the current balance circuit 11, respectively. The current balance circuit 11*a* is connected to two cold-cathode tubes 3-*ia*, 3-*ib* of the group of (three) cold-cathode tubes 3-*ia*, 3-*ib*, 3-*ic*.

The other current balance circuit 11*b* is connected to the current balance circuit 11*a* and the cold-cathode tube 3-*ic*.

The cold-cathode tubes 3-*ia* is connected in series to one choke coil of the current balance circuit 11*a* and the cold-cathode tube 3-*ib* is connected in series to the other choke coil of the current balance circuit 11*a*. The cold-cathode tube 3-*ic* is connected in series to one choke coil of the current balance circuit 11*b*. Further, the other choke coil of the current balance circuit 11*a* is connected in series to the other choke coil of the current balance circuit 11*b*. Of both ends of one choke coil of the current balance circuit 11*a* and both ends of both the choke coils of the current balance circuit 11*a*, the ends not having the cold-cathode tubes 3-*ia*, 3-*ib* or the other choke coil of the current balance circuit 11*a* connected thereto are connected to each other.

Further, the time division FETs 4-1 to 4-N are the plurality of switching elements connected in series to the respective groups of cold-cathode tubes (3-1*a*, 3-1*b*, 3-1*c*) to (3-Na, 3-Nb, 3-Nc) and the current balance circuits 11*a*, 11*b*, respectively.

Note that the other components in FIG. 4 are the same as in the mode 1 (FIG. 1), so that the description thereof will be omitted here.

Subsequently, the description will be given of the operation of the above-described apparatus.

In the mode 3, as in the mode 1, the high frequency voltage after boosted is applied to the series circuit composed of the cold-cathode tubes 3-*ia*, 3-*ib*, 3-*ic*, the current balance circuits 11*a*, 11*b*, and the time division FET 4-*i* and the resistances 5-*i* (i=1 to N) by the inverter circuit 1 and the booster transformer 2. Further, in the same manner as in the mode 1, the gate signal Vgi is supplied to the respective time division FETs 4-*i* by the control circuit 6.

Accordingly, in the period where the time division FET 4-*i* is in the "on" state, the high frequency voltage after boosted by the booster transformer 2 is applied to both the ends of the cold-cathode tubes 3-*ia*, 3-*ib*, 3-*ic* to light the three cold-cathode tubes 3-*ia*, 3-*ib*, 3-*ic*. At that time, caused by the two current balance circuit 11*a*, 11*b*, the lamp current of the cold-cathode tube 3-*ia*, the lamp current of the cold-cathode tube 3-*b*, and the lamp current of the cold-cathode tube 3-*ic* have substantially the same waveform, so that the three cold-cathode tubes 3-*ia*, 3-*ib*, 3-*ic* emit the same amount of light each other.

Thus, in the period where the time division FET 4-*i* is in the "on" state, the group of three cold-cathode tubes 3-*ia*, 3-*ib*, 3-*ic* are lighted.

Meanwhile, in the same manner as in the mode 1, the control circuit 6 repeatedly turns on the time division FETs 4-1 to 4-N for a predetermined period only sequentially one by one at the cycle shorter than the cycle of the lamp current being based on the output voltage or output current of the inverter circuit 1 or the drop voltages by the resistances 5-1 to 5-N. Accordingly, under the control by the control circuit 6, the groups of (three) cold-cathode tubes (3-1*a*, 3-1*b*, 3-1*c*) to (3-Na, 3-Nb, 3-Nc) are lighted sequentially on an one-group by one-group basis repeatedly at the cycle shorter than the cycle of the output voltage or output current of the inverter circuit 1.

As described above, the cold-cathode tube driving apparatus according to the mode 3 includes the booster transformer 2, the plurality of cold-cathode tubes (3-1*a*, 3-1*b*, 3-1*c*) to (3-Na, 3-Nb, 3-Nc), and the control circuit 6 time-dividing the high frequency voltage boosted by the booster transformer 2 to apply the time-divided voltage to the cold-cathode tubes (3-1*a*, 3-1*b*, 3-1*c*) to (3-Na, 3-Nb, 3-Nc) sequentially by three cold-cathode tubes.

With this, the plurality of cold-cathode tubes (3-1*a*, 3-1*b*, 3-1*c*) to (3-Na, 3-Nb, 3-Nc) are driven by the single booster transformer 2, so that the number of the booster transformers can be reduced and thereby the increase in the installation space and in the cost can be suppressed as compared to the case where the booster transformer is provided to each of the plurality of cold-cathode tubes. Further, the one switching element (time division FET 4-*i*) performs the lighting control of the three cold-cathode tubes 3-*ia*, 3-*ib*, 3-*ic*, so that the number of the switching elements (time division FETs 4-*i*), furthermore, the number of gate signals generated by the control circuit 6 and the number of wirings from the control circuit 6 to the switching elements can be reduced.

Mode 4

A cold-cathode tube driving apparatus according to a mode 4 is additionally provided with a resistance 23 between the end of a primary wiring of the booster transformer 2 and a ground, also with resistances 24-1 to 24-N between drains of the respective time division FETs 4-1 to 4-N, as to control cold-tubes 3-1 to 3-N based on them.

Figure 5:
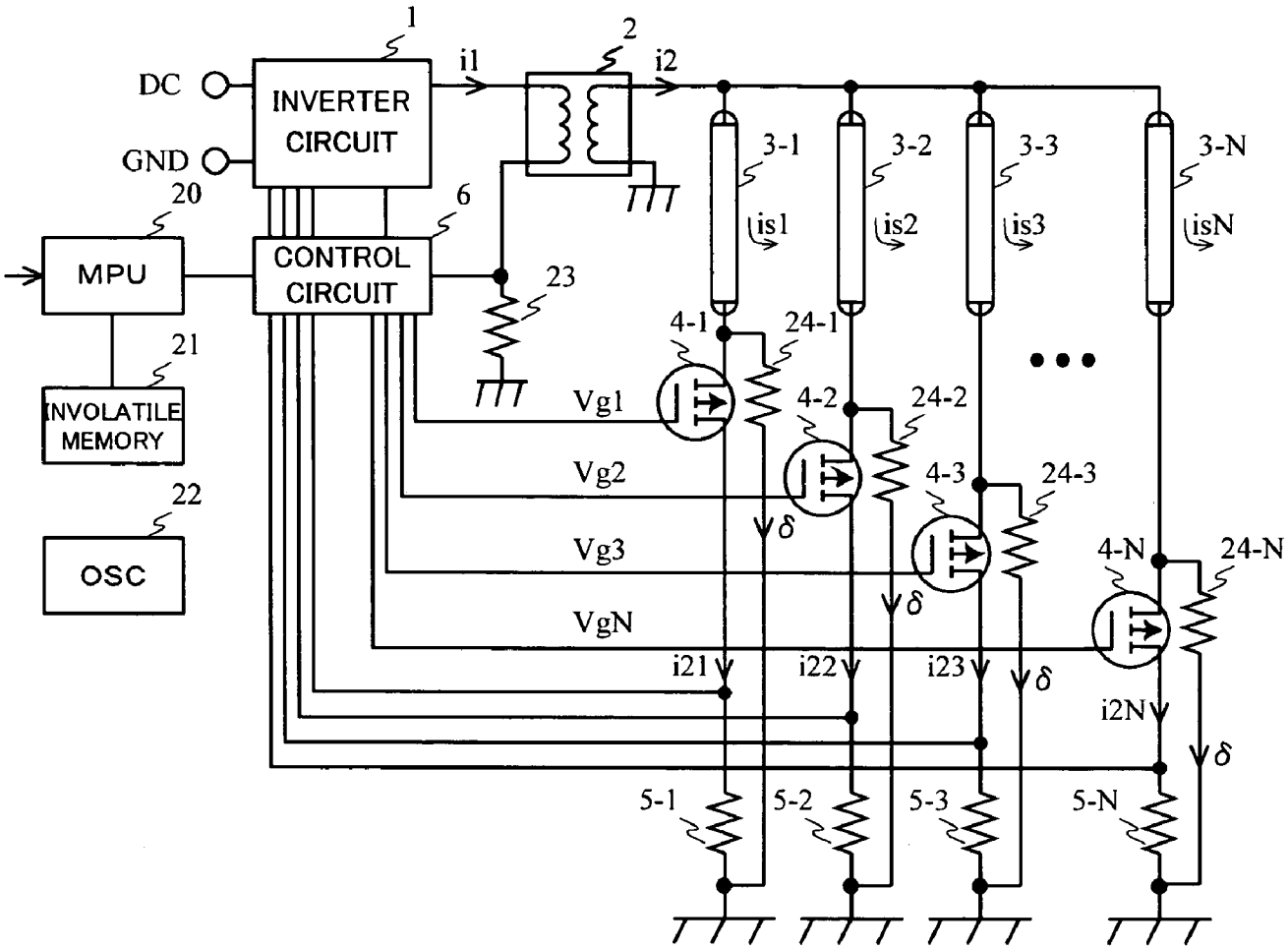
FIG. 5 is a circuit diagram showing a configuration of a cold-cathode tube driving apparatus according to an embodiment 4 of the present invention.

FIG. 5 is a circuit diagram showing a configuration of the cold-cathode tube driving apparatus according to the mode 4 of the present invention. In FIG. 5, as previously described, the resistance 23 is additionally provided between the end of the primary wiring of the booster transformer 2 and the ground, and resistances 24-1 to 24-N are additionally provided between drains of the respective time division FETs 4-1 to 4-N and the grounds, respectively. In addition, an MPU (Main Processing Unit) 20 is connected to the control circuit 6 and an involatile memory 21 is connected to the MPU 20. Further, an OSC (Oscillator) 22 generating a timing signal controlling the entire apparatus is additionally provided.

Note that the other components in FIG. 5 are the same as in the mode 1 (FIG. 1), so that the description thereof will be omitted here.

Here, the MPU 20 is a circuit receiving a control signal from a not-shown superior circuit to control respective sections of the cold-cathode tube driving apparatus based on the control signal and information stored in the involatile memory 21.

The involatile memory 21 is composed of, for example, an EEPROM (Electronically Erasable and Programmable Read Only Memory) and the like and stores program or data required for MPU 20 to control.

The OSC 22 is composed of, for example, a PLL (Phase Lock Loop) circuit and the like, and inputted a signal (for example, a flame signal of a liquid crystal display device) from a not-shown superior circuit to output a signal synchronized therewith.

The resistance 23 is inserted into between the end of the primary wiring of the booster transformer 2 and the ground to generate a voltage in accordance with the current flowing in the primary wiring to supply the voltage to the control circuit 6. The control circuit 6 includes an A/D converter converting the imputed voltage (analog signal) into a digital signal to import the digital signal.

The resistances 24-1 to 24-N are connected in parallel to between the drains and the grounds of the time division FETs 4-1 to 4-N, respectively, to flow the current over the kick-off current with respect to the cold-cathode tubes 3-1 to 3-N as bias current, as will be described later.

Subsequently, the description will be given of the operation of the above-described apparatus.

Figure 6:
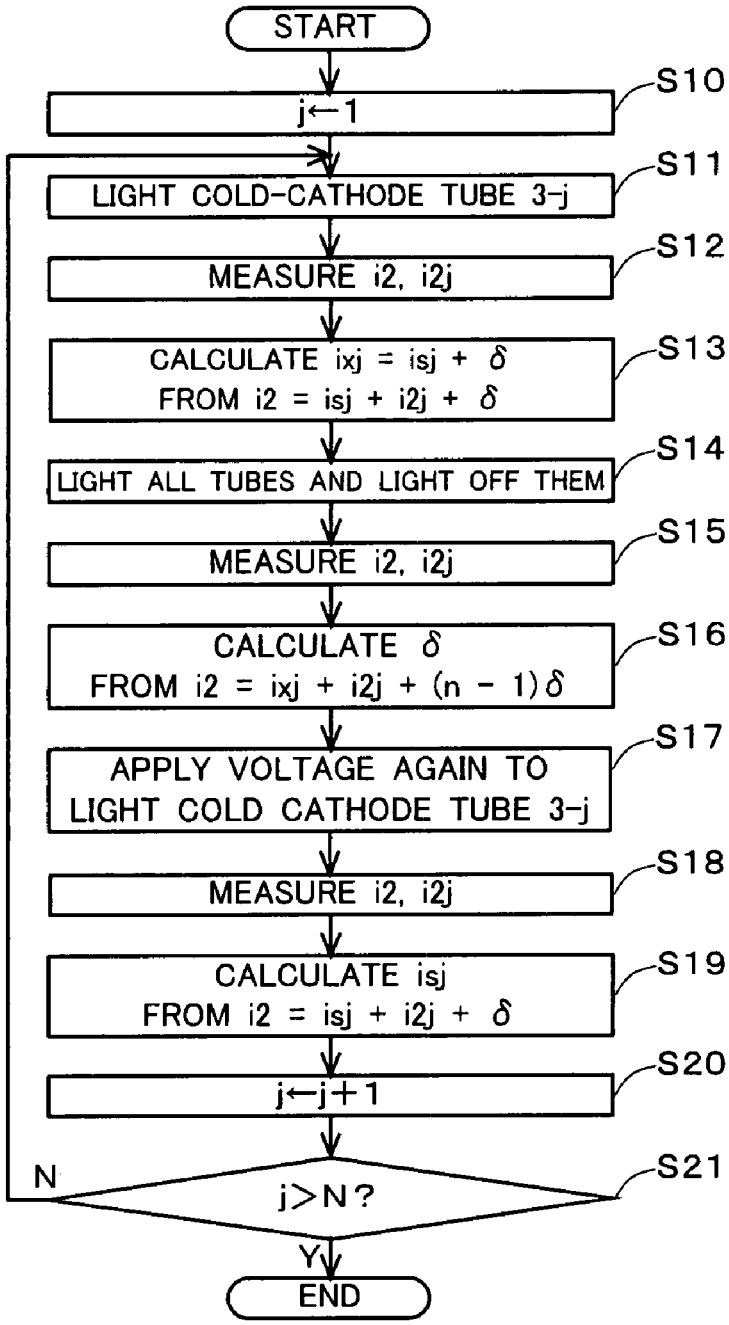
FIG. 6 is a flowchart illustrating a process flow executed before lighting the cold-cathode tube in the embodiment 4 shown in FIG. 5.

First, in the mode 4, when the power is turned on or a instruction is made from the not-shown superior circuit, a process shown in FIG. 6 is executed to measure the characteristics of the cold-cathode tubes 3-1 to 3-N. The detailed process will be described below.

Step S10: the MPU 20 assigns an initial value "1" to a variable counting the number of processes.

Step S11: the MPU 20 lights the cold-cathode tube 3-*j*. Specifically, the MPU 20 sends the control signal to the control circuit 6 to light the cold-cathode tube 3-*j*. As a result, the control circuit 6 makes the gate signal Vgj of the time division FET 4-*j* be in the high state, the FET 4-*j* therefore turns into the "on" state, and the cold-cathode tube 3-*j* is lighted. Note that, in the present example (j=1), the gate signal Vg1 of the time division FET 4-1 is made in the high state, the time division FET 4-1 turns into the "on" state, and the cold-cathode tube 3-1 is lighted.

Step S12: the MPU 20 measures current i2, i2*j*. Specifically, the MPU 20 measures the current i2*j* by detecting the voltage generated at the resistance 5-*j* and, at the same time, detecting current i1 flowing in the resistance 23 to obtain the current i2 by applying a turn ratio and a conversion efficiency to the detected current i1. In the present example, the current i21 flowing in the time division FET 4-1 and the current i2 can be obtained. Note that the A/D converter is built in the control circuit 6 as described above, therefore, the voltages generated at the resistance 23 and the resistance 5-*j* are detected using the A/D converter and by dividing the detected voltages by the resistance values of the resistances, respectively, to obtain the current value.

Step S13: the MPU 20 obtains ixj (=isj+δ) being the sum of leak current isj from the cold-cathode tube 3-*j* and bias current flowing toward the resistance 24-*j* based on the equation 1 below. Here, the leak current means the current leaking to an external conductor via parasitic capacitance (or stray capacitance) formed between the cold-cathode tube and the external conductor (for example, a conductive reflecting sheet formed by sputtering silver onto PET). Specifically, positive-column plasma generated inside the cold-cathode tube in the lighted state is a conductor, and a capacitor is formed between the conductor and the external conductor. This is the parasitic capacitance. (number 1)

$$i2=isj+i2j+\delta \quad \text{(equation 1)}$$

Figure 7:
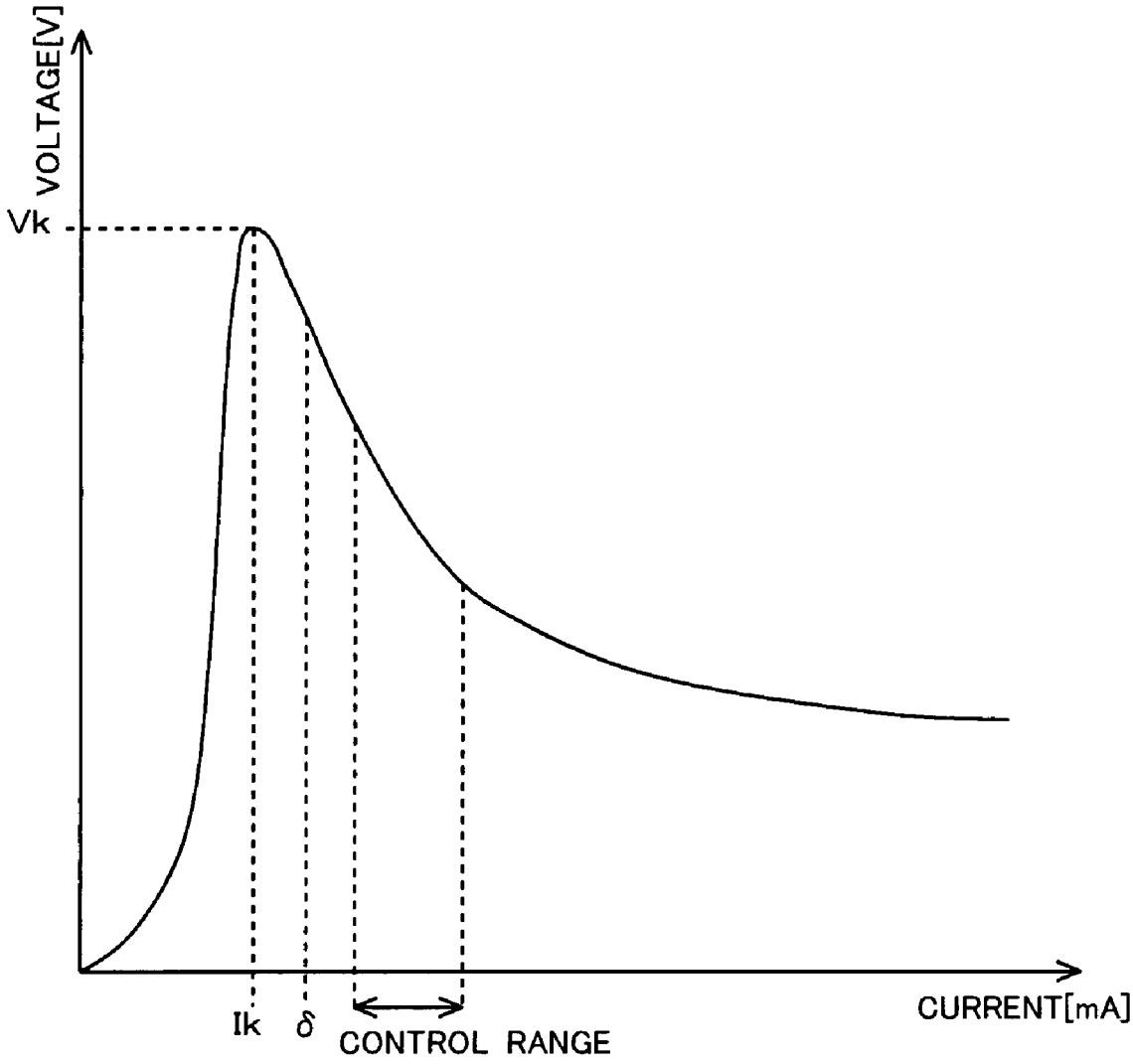
FIG. 7 is a view showing a relation between voltage and current applied to the cold-cathode tube.

Meanwhile, the bias current δ flowing in the resistance 24-*j* is the bias current to put the cold-cathode tube 3-*j* into the state where the voltage of the kick-off voltage or above is applied on a constant basis. FIG. 7 is a view showing a voltage-current characteristic of the cold-cathode tube. As shown in the drawing, when the voltage applied to the cold-cathode tube 3-*j* is increased, the current flow gradually increases, and the voltage drops when exceeding the kick-off voltage Vk. In the mode 4, the resistance 24-*j* is connected to between the drain and the ground of the time division FET 4-*j* and thereby the cold-cathode tube 3-*j* is put into the state where the current (kick-off current Ik) corresponding to the kick-off current Vk or above flows on a constant basis therein, it is therefore configured that the current within a control range (appropriate range) flows under the control of the switching of the time division FET 4-*j*. Thus, by flowing the bias current δ to the respective cold-cathode tubes, a delay time until the time division FET 4-*j* turns on to emit light can be reduced. Further, when flowing no bias current δ, it is necessary that the voltage over the kick-off voltage Vk be applied every time the time division FET 4-*j* turns on, however, the bias current flow can lower the voltage to be applied, so that power-saving is realizable depending on the setting manner of the bias current δ.

Note that the control range is set in the vicinity of the current value at which the light emitting efficiency of the cold-cathode tube 3-*j* reaches the highest. When the switching by the FET 4-*j* is not performed, although a predetermined current determined by the cold-cathode tube 3-*j*, the booster transformer 2 and the other parameter (parasitic capacitance and the like) flows, the current value does not show the highest light emitting efficiency, in general. Therefore, by setting the current within a range showing the high light-emitting efficiency by the switching, the power-saving can be realized.

Although the bias current δ and the control range depart from each other in FIG. 7, the bias current δ may be set to match with the lowest limit of the control range.

Step S14: the MPU 20 lights every cold-cathode tubes except the cold-cathode tube 3-*j* and lights out them thereafter. In the present example, the cold-cathode tube 3-1 is in the lighted state, therefore the time division FETs 4-2 to 4-N are put into the "on" state and then put into an "off" state. As a result, the cold-cathode tubes 3-2 to 3-N are lighted and lighted out thereafter. Note that they are turned off after being tuned on in order to make the bias current flow with respect to the resistances 24-2 to 24-N. Specifically, in the present example, as a result of the process in Step S14, the cold-cathode tube 3-1 is lighted and all the others are put into the lighted out state and at the same time the resistances 24-2 to 24-N are put into the state where the bias current flows therein.

Step S15: the MPU 20 measures the current i2*j* by detecting the voltage generated at the resistance 5-*j* and, at the same time, detecting current i1 flowing in the resistance 23 to obtain the current i2 by applying the turn ratio and the conversion efficiency to the detected current i1. In the present example, the current i21 flowing in the time division FET 4-1 and the current i2 can be obtained.

Step S16: the MPU 20 obtains the bias current δ flowing to the resistance 24-*j* based on the equation 2 below. Here, the bias current δ is assumed to be substantially the same in all the cold-cathode tubes 3-1 to 3-N. Further, the bias current δ are actually different between when the time division FET 4-*j* is in the "on" state and when it is in the "off" state, however, the difference is assumed to be slight and these are treated as substantially the same. (number 2)

$$i2=ixj+i2j+(n-1)\delta \quad \text{(equation 2)}$$

Step S17: the MPU 20 applies the voltage to the inverter circuit 1 again to light the cold-cathode tube 3-*j* again. Specifically, the voltage of the inverter circuit 1 is once stopped, and after making the bias current δ flowing in the resistances 24-1 to 24-N be in the "0 (zero)" state, the cold-cathode tube 3-*j* is lighted again. In the present example, the MPU 20 makes the time division FET 4-*j* be in the "on" state to thereby light the cold-cathode tube 3-*j*. In the present example, it is put into the state where the time division FET 4-1 is made in the "on" state, the cold-cathode tube 3-1 is lighted and the bias current flows in the resistance 24-1 only.

Step S18: the MPU 20 measures the current i2*j* by detecting the voltage generated at the resistance 5-*j* and, at the same time, detecting current i1 flowing in the resistance 23 to obtain the current i2 by applying the turn ratio and the conversion efficiency to the detected current i1. In the present example, the current i21 flowing in the time division FET 4-1 and the current i2 can be obtained. Note that the measurement method of the current is the same as in Step S15.

Step S19: the MPU 20 calculates the leak current isj based on the equation 1 stated above. Specifically, the MPU 20 obtains the value isj by assigning the value δ obtained in Step S16 and i2, i2*j* measured in Step S18 to the equation 1. In the present example, by assigning the value δ and i2, i21 measured in Step S18 to the equation 1, the leak current is1 can be obtained. Note that the value isj obtained is stored in the involatile memory 21.

Step S20: the MPU 20 incrementally increases a variable j counting the number of processes by one.

Step S21: the MPU 20 determines whether or not the value of the variable j exceeds the number N of the cold-cathode tubes, and in the case where it exceeds, then ends the process, and in the other case, returns to the Step S11 to repeat the same process. In the present example, since it is in the state of "j=2" based on the process of Step S21, therefore, it is determined to be "NO" in Step S21, and the process returns to Step S11 to execute the process in the case of j=2.

With the processes described above, the bias current δ and the leak current isj can be obtained. By referring to the bias current δ and the leak current isj thus obtained, whether or not the cold-cathode tubes 3-1 to 3-N operate within the appropriate range can be determined. Specifically, in an adjustment stage before shipping, by directly referring to these values, whether or not the cold-cathode tube operates within the operating range in the vicinity of the designed value can be determined for all the cold-cathode tubes 3-1 to 3-N. In case any of the cold-cathode tube does not operate within the operation range in the vicinity of the designed value, it is possible to prevent a failure from arising beforehand by replacing the cold-cathode tube.

Further, when it is after the shipping, it is possible to inform a user of the failure or the like that is caused. Specifically, when the leak current isj varies, it is assumable, for example, that the positional relation between the cold-cathode tube and the external conductor changes due to external pressure, or the like, so that the failure caused is presented to the user together with information (for example, the number (=1 to N) indicating the cold-cathode tube) to identify the cold-cathode tube. Further, when the bias current δ varies (is reduced), for example, it is assumable that the cold-cathode tube is reaching to its lifetime, so that the user is informed of the fact together with the information to identify the cold-cathode tube. With this, the user can be known the abnormal state or the like of the cold-cathode tube. Further, when the maker performs the repair, they can easily specify the cause.

Further, in general, it is known that the kick-off voltage characteristic varies (the peak of the kick-off voltage lowers) when the parasitic capacitance increases. Therefore, when the leak current isj shows a change, the case where a normal operation cannot be expected by the predetermined bias current is assumable, and in such a case (where the leak current isj varies), the operation may be stopped to notify the fact.

Figure 8:
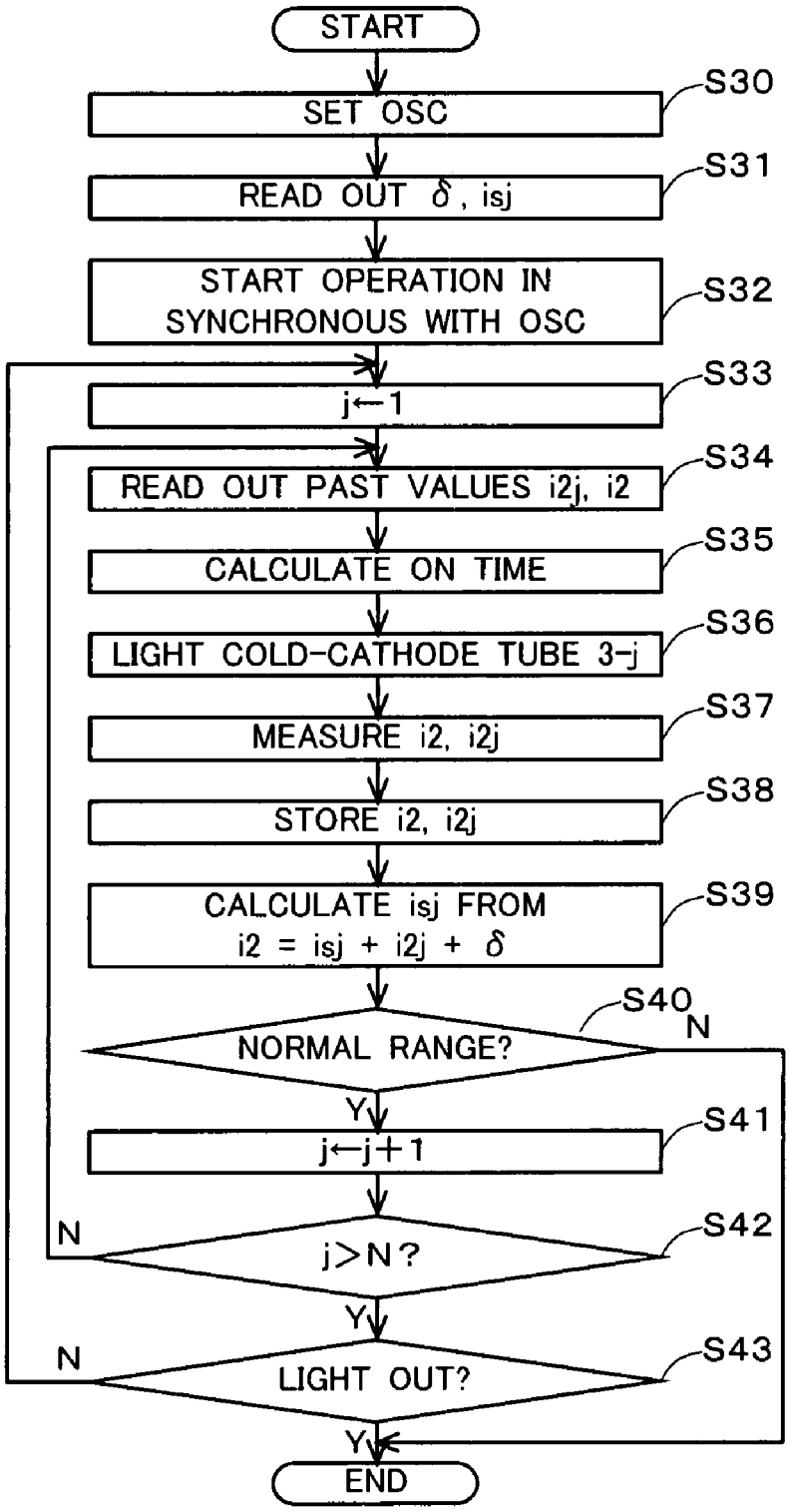
FIG. 8 is a flowchart illustrating a process flow executed before lighting the cold-cathode tube in the embodiment 4 shown in FIG. 5.

Subsequently, the description will be given of the operation when lighting the cold-cathode tubes 3-1 to 3-N. FIG. 8 is a flowchart to illustrate the lighting operation. This flowchart is executed after the process in FIG. 6 is ended. When this flowchart is started, the following steps are executed.

Step S30: the OSC 22 is set. The OSC 22 is composed of the PLL or the like and outputs a reference signal synchronized with the signal inputted by the not-shown superior circuit. Specifically, the OSC 22 has, for example, a cycle of 30 ms or 40 ms being a frame cycle of the liquid crystal display device and generates and outputs the reference signal synchronized with a driving signal of the liquid crystal display device. By using the signal thus synchronized with the frame cycle as a reference signal, the display timing of the liquid crystal and the lighting timing by a backlight are synchronized, allowing a flicker noise to be prevented from arising.

Step S31: the MPU 20 reads out the values δ, isj (j=1 to N) (the values stored in the process in FIG. 6) stored in the involatile memory 21.

Step S32: the MPU 20 supplies the control circuit 6 with the control signal to operate the inverter circuit 1 in a synchronous manner with the reference signal outputted by the OSC 22. As a result, the inverter circuit 1 generates a sine wave in a synchronous manner with the reference signal supplied from the OSC 22.

Step S33: the MPU 20 assigns the initial value "1" to the variable j counting the number of processes.

Step S34: the MPU 20 reads out the values i2, i2*j* in the past stored in the involatile memory 21 in the process in later-described Step S38. Note that, the values i2, i2*j* for 3 to 10 cycles of AC voltage outputted by the inverter circuit 1 are stored in the involatile memory 21 and are read out in Step S34. In the first process, these values are not stored yet, so that no readout is performed.

Step S35: the MPU 20 calculates an on time being the time keeping the time division FET 4-*j* in the "on" state based on the values read out in Step S34. Specifically, the time division FET 4-*j* is controlled by the PWM (Pulse Width Modulation) control and calculates the on time based on, for example, the average value of i2, i2*j* for the past 3 to 10 cycles read out in Step S34. More specifically, for example, the current flowing in the cold-cathode tube 3-*j* is expressed by i2*j*+δ (provided that "δ" is constant), therefore, when the average value of i2*j*+δ for the past 3 to 10 cycles is smaller than a predetermined value, the pulse width is made wider than a reference width, and when the average value is larger than the predetermined value, the pulse width is made narrower than the reference width. Note that the average value may be for past 1 to 2 cycles instead of past 3 to 10 cycles.

Step S36: the MPU 20 puts the time division FET 4-*j* into the "on" state for only the on time obtained in Step S35 to thereby light the cold-cathode tube 3-*j*.

Step S37: the MPU 20 sends the control signal to the control circuit 6 make the control circuit 6 to measure the values i2, i2*j* during the period that the cold-cathode tube 3-*j* is lighted. Specifically, i2*j* is calculated from the voltage generated at the resistance 5-*j* and i2 is calculated by applying the turn ratio and the conversion efficiency to the voltage generated at the resistance 23.

Step S38: the MPU 20 obtains the values i2, i2*j* measured by the control circuit 6 to store them in the involatile memory 21. Note that the involatile memory 21 is designed to store the values i2, i2*j* for 3 to 10 cycles and to delete the values over them from the oldest one to overwrite new values.

Step S39: the MPU 20 obtains the leak current isj by assigning the values i2, i2*j* measured in Step S37 to the equation 1 described above.

Step S40: the MPU 20 refers to the values i2, i2*j* measured in Step S37 and the value isj calculated in Step S39 to determine whether or not the values are within the normal range. As a result, when they are not within the normal range, the superior circuit is informed of a occurrence of the abnormal state and the process is ended as well. In the other case, then the process goes to Step S41.

Step S41: the MPU 20 incrementally increases the variable j counting the number of processes by "one".

Step S42: the MPU 20 determines whether or not the value j exceeds the value N, and when it exceeds, the process goes to Step S43 and, in the other case, the process returns to Step S34 to repeat the same process as described above.

Step S43: the MPU 20 determines whether or not the instruction to light out the cold-cathode tube is made by the superior circuit, and when the light-out instruction is made, the process ends, and, in the other case, the process returns to Step S33 to repeat the same process as described above.

According to the above-described process, it is designed that the reference signal is outputted from the OSC 22 in a synchronized manner with the signal supplied from the superior circuit, in which the cold-cathode tube 3-*j* is lighted based on the reference signal, so that, when the cold-cathode tube 3-*j* is used, for example, as a backlight of the liquid crystal display device, by operating with the reference signal synchronized with the frame cycle, the flicker nose is prevented from arising.

Further, according to the above-described process, it is designed that the currents i2, i2*j*, isj are detected and the time division FET 4-*j* is controlled based on the detected values, so that the current flowing in the respective cold-cathode tubes can be controlled precisely. Further, as a result, the luminance of the respective cold-cathode tubes can be kept to be constant, so that, when it is used, for example, as a backlight of the liquid crystal display device, luminance unevenness between the respective cold-cathode tubes can be eliminated. Specifically, it is possible to measure and control the current of the respective tubes more precisely, so that a more-precise luminance control can also contribute to eliminate the luminance unevenness of a TV monitor or the like.

Further, in the case where the light-emitting efficiency is increased by generating a third harmonic by way of resonating at a triple frequency of a fundamental frequency between the secondary wiring of the booster transformer 2 and the parasitic capacitance, it is possible to adjust to resonate at the third harmonic by measuring the leak current isj and controlling based thereon. Specifically, in the case where no resonance arises, the adjustment is performed so that the current of the value multiplied by a value Q of a resonance circuit flows as a leak current isj, by changing the switching frequency of the time division FETs 4-1 to 4-N or by changing the oscillatory frequency of the inverter circuit 1. With this, it is possible to resonate at the triple frequency.

In the above-described modes, the respective cold-cathode tubes are controlled to have the constant luminance by controlling the current flowing in the respective cold-cathode tubes to be constant. However, when the respective cold-cathode tubes have a different current-luminance characteristic, the constant current cannot always make the luminance be the same. Therefore, by executing the process shown in FIG. 9, the luminance of the respective cold-cathode tubes can be kept constant even when the respective cold-cathode tubes have the different current-luminance characteristic. Note that as a premise of executing the process in FIG. 9, the respective current-luminance characteristics of the cold-cathode tubes are measured in advance, and at the same time, the respective target tube current values in the cold-cathode tubes are stored in the involatile memory 21. Specifically, the target tube current value of the cold-cathode tube 3-1 is 3 mA, that of the cold-cathode tube 3-2 is 3.5 mA, that of the cold-cathode tube 3-3 is 4 mA, . . . , and soon.

Step S50: the MPU 20 obtains the target tube current value of each of the respective cold-cathode tubes stored in advance in the involatile memory 21. Note that, it is possible to store a count value generated in Step S51 in advance and to obtain the count value in stead of the target tube current value itself.

Step S51: the MPU 20 multiplies the target tube current value obtained in Step 50 by a constant number to generate the count value, respectively. For instance, when the target tube current value of the cold-cathode tube 3-1 is 3 mA, "3" is multiplied by "10" to obtain "30" as a count value, as an example. Note that the constant multiple other than "10" is also acceptable.

Step S52: the MPU 20 stores the count value generated in Step S51 in the ring buffer provided in the involatile memory 21. As a result, the count values corresponding to the cold-cathode tubes 3-1 to 3-N are stored sequentially in the ring buffer.

Step S53: the MPU 20 selects the maximum count value from among the count values stored in the ring buffer. For instance, in the case where the count value of the cold-cathode tube 3-1 is "30", that of the cold-cathode tube 3-2 is "35", that of the cold-cathode tube 3-3 is "40" and those of the rest are all "30", the count value "40" corresponding to the cold-cathode tube 3-3 is selected.

Note that when a plurality of maximum count values exist, the cold-cathode tube having a smaller number is selected by priority, as an example. Or otherwise, the selection at random based on a random number is also acceptable.

Step S54; the MPU 20 lights the cold-cathode tube corresponding to the count value selected in Step S53 for the predetermined time only. Specifically, the MPU 20 puts the time division FET controlling the cold-cathode tube corresponding to the maximum count value into the "on" state for the predetermined time only. Note that, in the present example, differently from the previous example, the time division FET is put into the "on" state for the predetermined time only instead of the PWM control.

Step S55: the MPU 20 measures current i2*y* flowing in the cold-cathode tube lighted in Step S54. Specifically, i2*y*=i2*j*+δ (δ is assumed to be constant), therefore, i2*j* is measured and the result obtained and the δ obtained in advance are assigned to the equation to thereby calculate i2*y*.

Step S56: the MPU 20 subtracts the value corresponding to i2*y* from the maximum count value selected in Step S53. For instance, when the count value is "40" and when i2*y* is 4 mA, as a value corresponding to i2*y*, "4" is subtracted from the count value "40".

Step S57: the MPU 20 determines whether or not the result of the subtraction in Step S56 is a nonnegative number, and when it is a nonnegative number (the value equal to 0 (zero) or more), the process goes to Step S59, and in the other case (where a carried over F is generated), the process goes to Step S58.

Step S58: the MPU 20 generates the carried over F as to the count value. As a result, from the subsequent process, the count value is eliminated from the target of the process (eliminated from the selection target in Step S53).

Step S59: the MPU 20 determines whether or not the carried over F is generated as to all the count values stored in the ring buffer, and when the carried overs F are generated as to all the count values, the process goes to Step S60, and in the other case, the process returns to Step S53 to repeat the same process.

Step S60: the MPU 20 deletes all the carried overs F to reactivate the entire ring buffer. As a result, all the count values are set as the targets of the process.

Step S61: the MPU 20 determines whether or not the superior circuit makes the instruction to light out, and when the light-out instruction is made, the process ends, and, in the other case, the process returns to Step S53 to repeat the same process.

According to the above-described process, on the assumption that the tube current flowing in the respective cold-cathode tubes is almost constant, the frequency of becoming the "on" state in a unit time varies depending on the size of the count value. Specifically, when the count value is large, the frequency of becoming the "on" state in the unit time is large, while when the count value is small, the frequency of becoming the "on" state in the unit time is small. Since the count value is set in accordance with the target tube current value, the cold-cathode tube having a large target tube current value (the cold-cathode tube having a smaller luminance with respect to the current) is put into the "on" state at a high frequency while the cold-cathode tube having a small target tube current (the cold-cathode tube having a larger luminance with respect to the current) is put into the "on" state at a low frequency, so that the luminance of the respective cold-cathode tubes can be kept substantially the same.

Further, in the above-described process, it is designed that the ring buffer is used and when the subtraction is resulted in the negative number, the carried over F is generated to be excluded from the process target, and when all the carried overs F are generated, they are cleared to be reset as the process target.

Therefore, for example, in comparison with the case where the ring buffer is cleared to reset an initial value when the subtraction is resulted in the negative number, an error can be prevented from accumulating. Specifically, in such a method, in the case where the initial value is "40", when the subtraction goes advance to the value "2" and when the current value being the subtractive value is "4", the subtraction is resulted in the negative value, which is eliminated from the subsequent selection, and at the time when the entire ring buffer is deleted later, the initial value "40" is reloaded to be reactivated. Therefore, the error is accumulated to the extent of the current value "2" (=4−2), which was unable to be subtracted when the value is "2".

Meanwhile, in the case of the present mode, although the value subtracted 4 from 2 is "−2", since the ring buffer is "40", the result comes to "38", so that the carried over F is generated and the case is eliminated from the process target. When all the carried overs F are generated, the same process is repeated by setting "38" as an initial value, causing no accumulation of the error.

Figure 10:
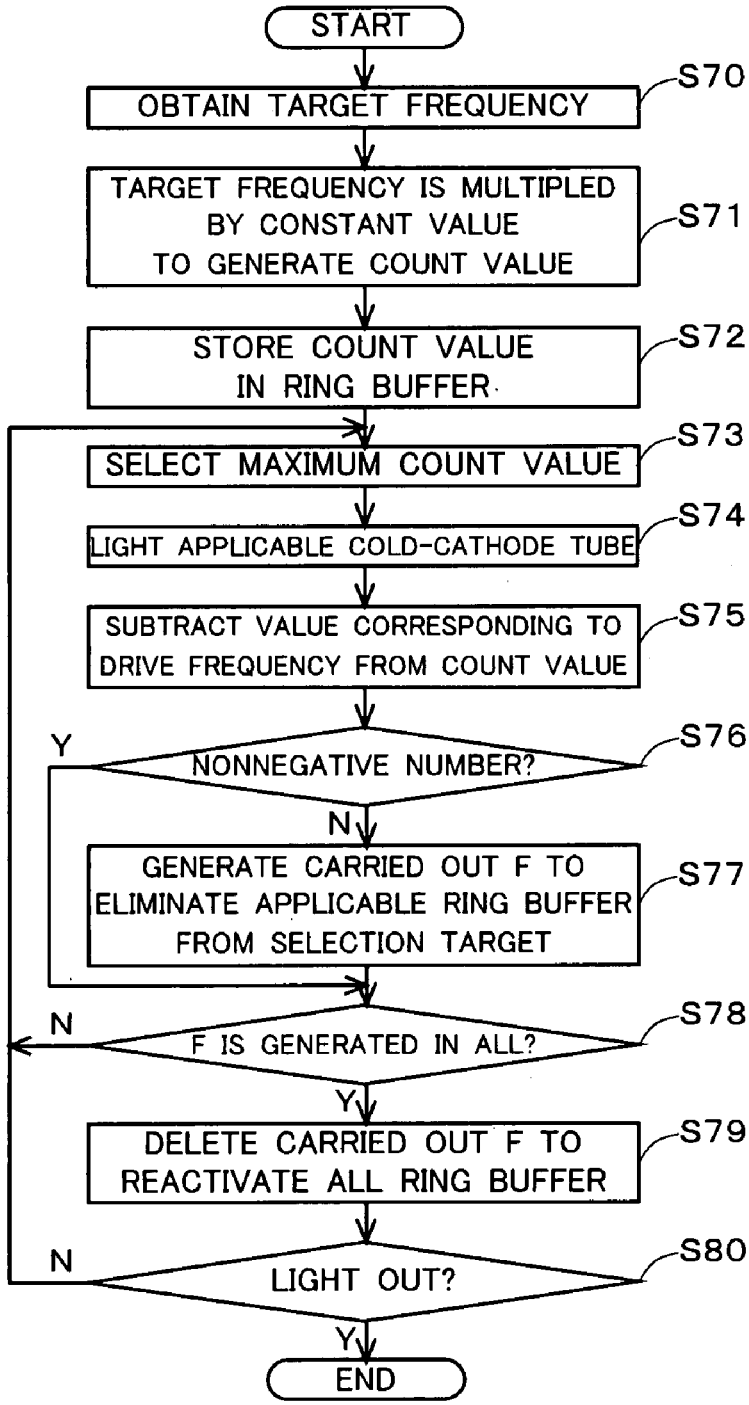
FIG. 10 is a flowchart to illustrate a process flow in the case where a control is performed in accordance with a target frequency in the embodiment 4 shown in FIG. 5.
Figure 11:
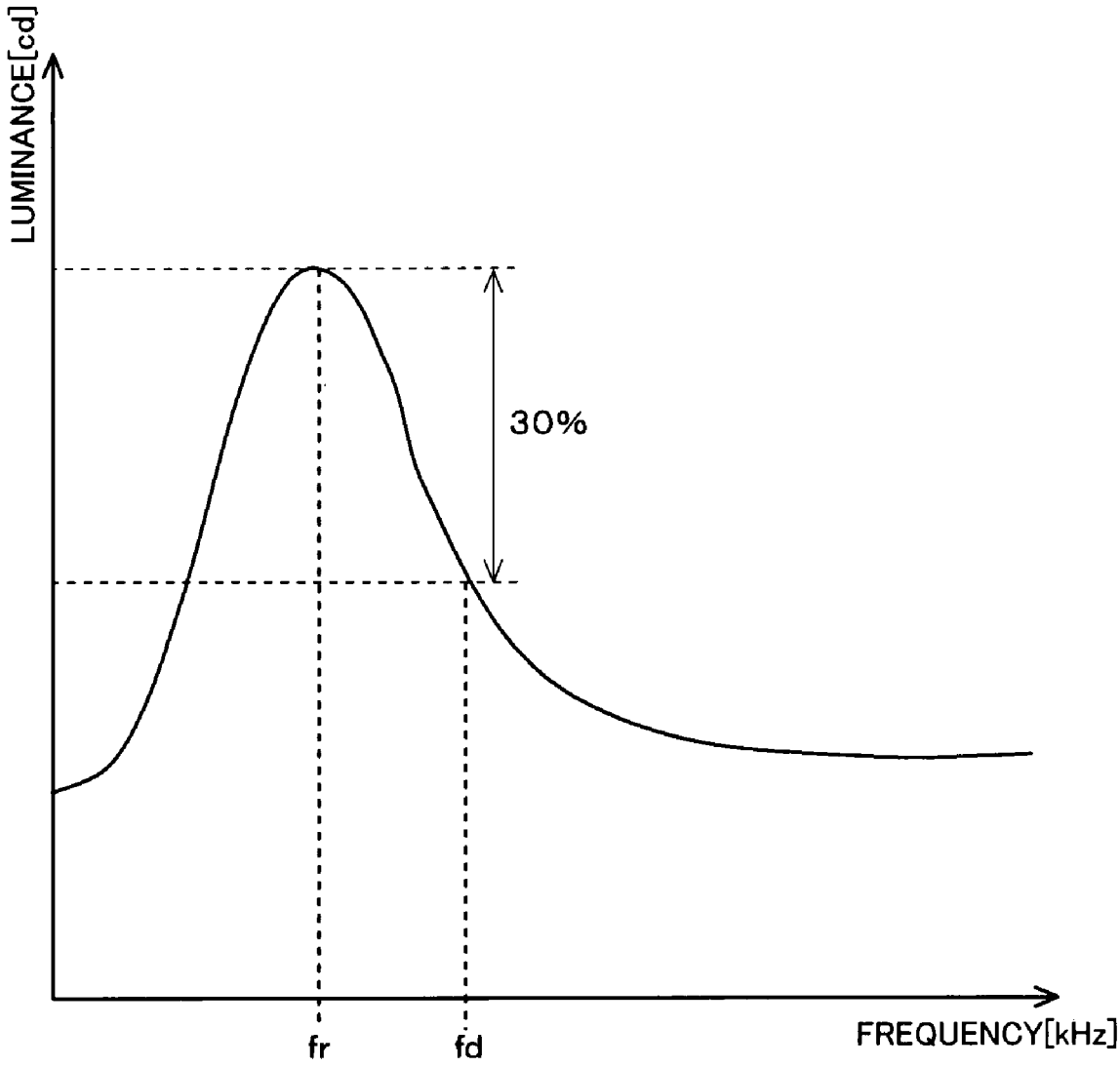
FIG. 11 is a view showing a relation between driving frequency and luminance of the cold-cathode tube.
Figure 12:
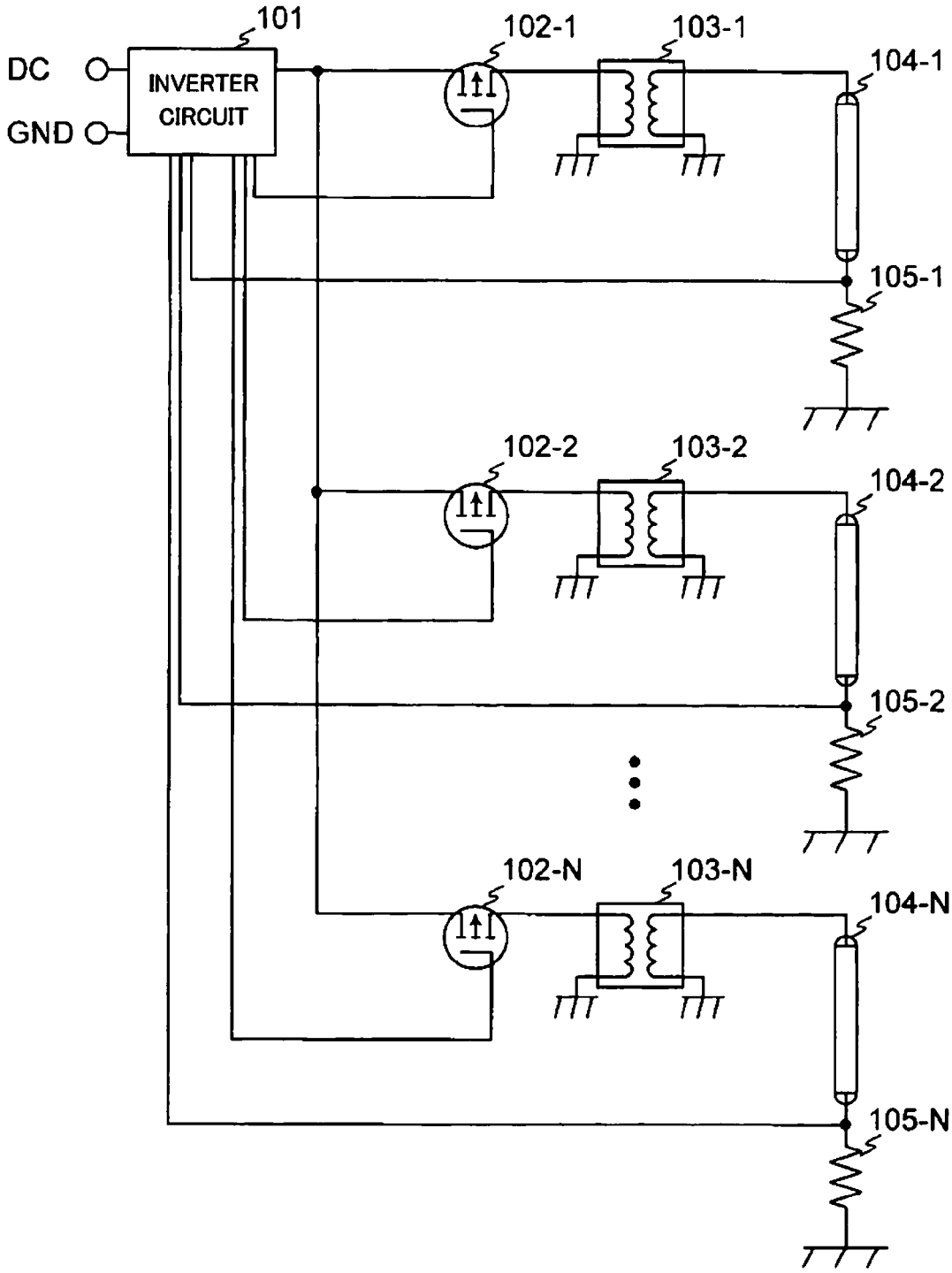
FIG. 12 is a circuit diagram showing a conventional cold-cathode tube driving apparatus.

Although the description above is an example when performing the control using the target tube current value as a control target, it is also possible to perform the control using the target frequency as a control target. FIG. 10 is a flowchart illustrating a process flow when the target frequency is determined and the control is performed using the target frequency as a control target. Note that, as a premise of this process, the respective cold-cathode tubes have the luminance-frequency characteristic as shown in FIG. 11. Here, the luminance is maximized at a resonance frequency fr determined by an inductance of the booster transformer 2 and the parasitic capacitance of the cold-cathode tube. However, at the resonance frequency fr, the voltage applied to the cold-cathode tube is caused to have a higher frequency than the other frequencies, so that the consumption power is increased. Further, since the inductance of the booster transformer 2 and the parasitic capacitance of the cold-cathode tube also vary caused by a temperature and the like, the resonance frequency fr is unstable. Therefore, by setting a time-division frequency to a drive frequency fd (the frequency corresponding to the luminance fell by 30% from the luminance of the resonance frequency fr) deviating from the resonance frequency fr, the stability is improved. Note that since the respective cold-cathode tubes have a specific resonance frequency, respectively, the drive frequency fd is set in accordance with the respective cold-cathode tubes to be stored in the involatile memory 21 as a target frequency, respectively, and the control as will be described below is performed.

Step S70: the MPU 20 obtains the target frequency of the respective cold-cathode tubes, which is stored in advance in the involatile memory 21. Note that, it is possible to calculate a count value generated in Step S71 in advance and to obtain the count value in stead of the target frequency.

Step S71: the MPU 20 multiplies the target frequency obtained in Step 70 by a constant number to generate the count value, respectively. For instance, when the target frequency of the cold-cathode tube 3-1 is 10 kHz, "10,000" is multiplied by "1/100" to obtain the count value "100", as an example. Note that the constant multiple other than "1/100" is also acceptable.

Step S72: the MPU 20 stores the count value generated in Step S71 in the ring buffer provided in the involatile memory 21. As a result, the count values corresponding to the cold-cathode tubes 3-1 to 3-N are stored in the ring buffer in order.

Step S73: the MPU 20 selects the maximum value from among the count values stored in Step S72. For instance, in the case where the count value of the cold-cathode tube 3-1 is "100", that of the cold-cathode tube 3-2 is "110", that of the cold-cathode tube 3-3 is "90" and those of the rest are all "105", the count value "110" corresponding to the cold-cathode tube 3-2 is selected.

Note that when the plurality of maximum count values exist, as in the previous case, the cold-cathode tube having the smaller number is selected by priority, as an example. Or otherwise, the selection at random based on the random number is also acceptable.

Step S74; the MPU 20 lights the cold-cathode tube corresponding to the count value selected in Step S73 for the predetermined time only. Specifically, the MPU 20 puts the time division FET controlling the cold-cathode tube corresponding to the maximum count value into the "on" state for the predetermined time only. Note that, also in the present example, differently from the previous example, the time division FET is put into the "on" state for the predetermined time instead of the PWM control.

Step S75: the MPU 20 subtracts the predetermined value corresponding to the average drive frequency of the time division FETs from the count value corresponding to the cold-cathode tube lighted in Step S74. For instance, when the average drive frequency is 50 kHz, "5" is subtracted from the count value, as an example. Note that the subtraction employing other than "5" is also acceptable.

Step S76: the MPU 20 determines whether or not the result of the subtraction in Step S75 is a nonnegative number, and when it is the nonnegative number (the value equal to 0 (zero) or more), the process goes to Step S78, and in the other case (where the carried over F is generated), the process goes to Step S77.

Step S77: the MPU 20 generates the carried over F as to the count value. As a result, from the subsequent process, the count value is eliminated from the target of the process (eliminated from the selection target in Step S73).

Step S78: the MPU 20 determines whether or not the carried over is generated as to all the count values stored in the ring buffer, and when the carried over F is generated as to all the count values, the process goes to Step S79, and in the other case, the process returns to Step S73 to repeat the same process.

Step S79: the MPU 20 deletes all the carried overs F to reactivate the entire ring buffer. As a result, all the count values are reset as the targets of the process.

Step S80: the MPU 20 determines whether or not the superior circuit makes the instruction to light out, and when the light-out instruction is made, the process ends, and, in the other case, the process returns to Step S73 to repeat the same process.

According to the above-described process, the frequency of becoming the "on" state in the unit time varies depending on the size of the count value. Specifically, when the count value is large, the frequency of becoming the "on" state in the unit time is large, while when the count value is small, the frequency of becoming the "on" state in the unit time is small. Since the count value is set in accordance with the target frequency, for the cold-cathode tubes having a high target frequency, they are put into the "on" state at a high frequency, and for those having a low target frequency, they are done so at a low frequency, so that the luminance of the respective cold-cathode tubes can be kept to be substantially the same. Further, it is possible to set the drive frequency to the frequency fd different from the resonance frequency fr of the respective cold-cathode tubes, so that a stable operation against a temperature change or the like can be expected.

Figure 9:
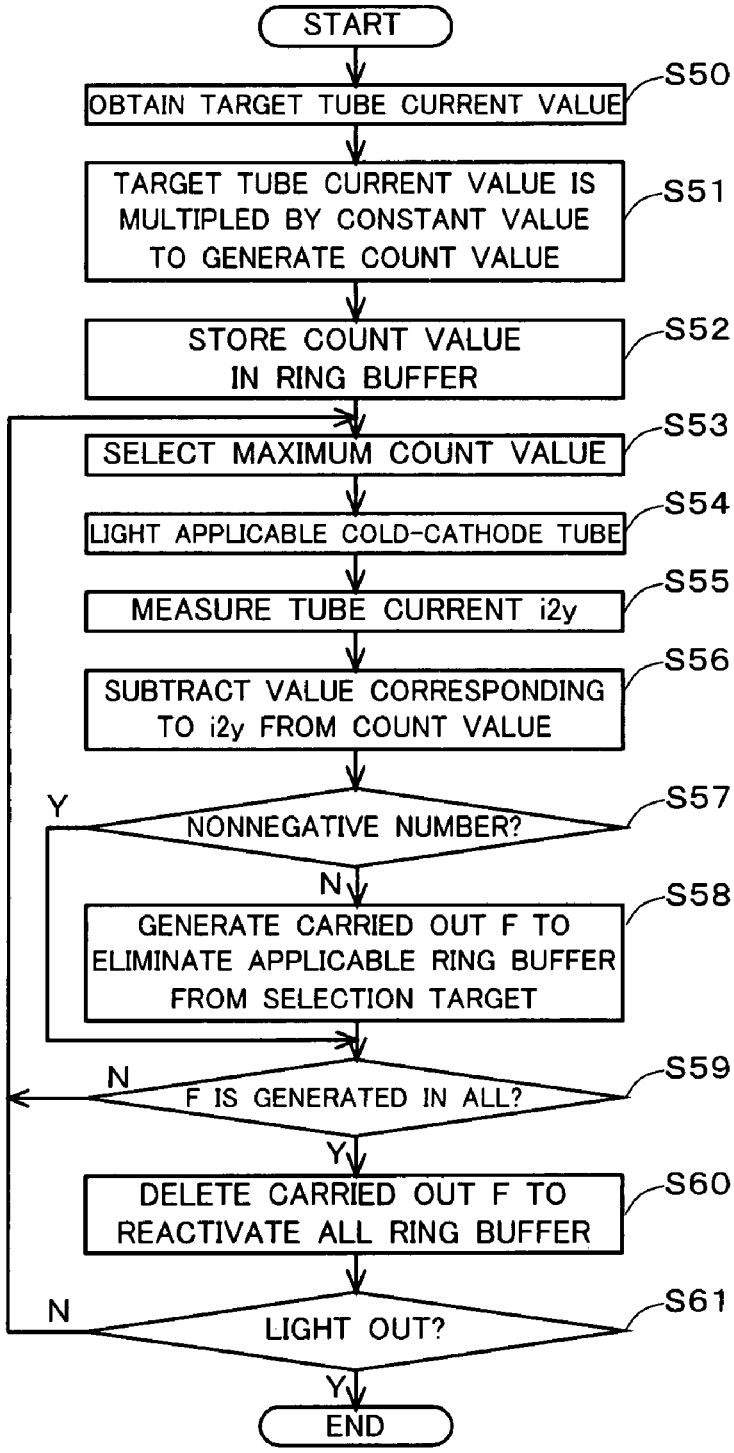
FIG. 9 is a flowchart to illustrate a process flow in the case where a control is performed in accordance with a target current value in the embodiment 4 shown in FIG. 5.

Further, according to the above-described process, as in the process in FIG. 9, no error is accumulated, so that the frequency can be controlled precisely.

Note that the above-described respective modes are preferred examples of the present invention, however, the present invention is not limited to the above and can be modified or altered in various manner without departing from the scope of the present invention.

For instance, in the above-described modes 1 to 4, the number of the cold-cathode tubes lighted all at once in a certain period is any one of one to three, however, the number of the cold-cathode tubes lighted all at once in the certain period may be four or more, and the four or more cold-cathode tubes may be controlled to be lighted by the single time division FET.

Further, the mode 4 may be configured that the plurality of cold-cathode tubes are connected as in the modes 2, 3. Note that, in that case, when the two cold-cathode tubes are connected, it is all right when the current flowing in these two cold-cathode tubes is defined as i2*j* and the current leaked from these two cold-cathode tubes is defined as the leak current isj. Further, when the three cold-cathode tubes are connected, it is all right when the current flowing in these three cold-cathode tubes is defined as i2*j* and the current leaked from these three cold-cathode tubes is defined as the leak current isj.

Further, in the above respective modes, when the current flowing in the respective cold-cathode tubes is adjusted, the current is designed to be controlled by controlling the "on" time, however, for example, the current value may be controlled by making the voltage of the sine wave generated by the inverter circuit 1 be variable. However, in that case, the voltage applied to all the cold-cathode tubes is caused to vary, therefore, an adjustment is made such that when the current flowing in all the cold-cathode tubes is small, the output voltage of the inverter circuit 1 is increased and when the current flowing in all the cold-cathode tubes is large, the output voltage of the inverter circuit 1 is reduced.

Further, in the mode 4, it is designed that the resistance 23 is inserted into the primary wiring side of the booster transformer 2, however, the resistance may be inserted into the secondary wiring side to detect the current. Note that the voltage is high at the secondary wiring side, so that the voltage is needed to be lowered by a voltage dividing or the like.

Further, in the above-described respective modes, as to the relation with the liquid crystal display device, no statement has been made, however, it is possible that the cold-cathode tube is disposed with the longitudinal direction thereof being in parallel with the horizontal scanning line of the liquid crystal panel to light the cold-cathode tube in accordance with the scanning of the horizontal scanning line. According to such a mode, the backlight is emitted only to the region of which horizontal scanning line is being scanned and the backlight is not emitted to the other region, so that an image deblurring caused by a slow response speed of the liquid crystal can be prevented.

INDUSTRIAL APPLICABILITY

The present invention is applicable to drive the plurality of cold-cathode tubes used in the backlight of the liquid crystal display, for example, in the liquid crystal TV, the liquid crystal monitor and the like.

The invention claimed is:

1. A cold-cathode tube driving apparatus comprising:

a booster transformer;

a plurality of cold-cathode tubes;

switching elements connected to said plurality of cold-cathode tubes;

a time division control circuit for lighting one or more of said plurality of cold-cathode tubes in a time division manner by use of a high frequency voltage after boosted by said booster transformer an inverter circuit generating the high frequency voltage at a predetermined cycle, wherein said time division control circuit divides the cycle of the high frequency voltage generated by said inverter circuit or the cycle of current supplied from said inverter circuit to the plurality of said cold-cathode tubes into two or more periods and lights one or more of said plurality of cold-cathode tubes for respective time-divided period sequentially by use of the high frequency voltage outputted from said booster transformer a resistance element which is connected in series to said plurality of cold-cathode tubes respectively and is connected in parallel to said switching elements respectively for applying bias current, a resistance element connected between said switching elements and a ground respectively for detecting current and a resistance element arranged at the ground side of a primary wiring or a secondary wiring of said booster transformer for detecting all secondary-side current.

2. The cold-cathode tube driving apparatus according to claim 1, wherein said time division control circuit performs the ON/OFF control of the respective switching elements in accordance with a voltage corresponding to a current value from resistance element for detecting all secondary-side current.

3. The cold-cathode tube driving apparatus according to claim 1, wherein said time division control circuit performs the ON/OFF control of the respective switching elements in accordance with an average value of the voltage generated at said resistance element(s) in a period of one cycle or more of the high frequency voltage outputted by said inverter circuit.

4. The cold-cathode tube driving apparatus according to claim 1, wherein said time division control circuit holds count values corresponding to target current being the current targeted to flow in the respective cold-cathode tubes, selects a maximum count value to light the corresponding cold-cathode tube, and subtracts a predetermined value thereafter, and when the count value results in a predetermined value or less, the count value is deleted to repeat a same process with respect to remaining count values.

5. The cold-cathode tube driving apparatus according to claim 1, wherein said time division control circuit holds count values corresponding to target frequencies being drive frequencies targeted by the respective cold-cathode tubes, selects a maximum count value to light the corresponding cold-cathode tube, and subtracts a predetermined value thereafter, and when the count value results in a predetermined value or less, the count value is deleted to repeat a same process with respect to remaining count values.

6. The cold-cathode tube driving apparatus according to claim 1, wherein a default is set in a state of applying bias current to said resistance elements with lighting said all cold-cathode tubes.

* * * * *

UNITED STATES PATENT AND TRADEMARK OFFICE

CERTIFICATE OF CORRECTION

PATENT NO. : 7,791,284 B2
APPLICATION NO. : 11/664895
DATED : September 7, 2010
INVENTOR(S) : Tadashi Otsuki, Toru Takahara and Akio Niewaka It is certified that error appears in the above-identified patent and that said Letters Patent is hereby corrected as shown below:

The filing date for PCT/JP 2005/018417 set forth in the issued patent is incorrect.

On the Title Page, Item (22) please change the listed date from "PCT: Aug. 8, 2005" to the correct date of --PCT: Oct. 5, 2005--.

Column 1, Line 6-10, please change the sentence "This application claims priority to international application number PCT/JP 2005/018417 filed on Aug. 8, 2005 which claims priority to Japanese patent application number 2004-295571 filed on Oct. 8, 2004, the entire disclosures of which are hereby incorporated by reference." to --This application claims priority to international application number PCT/JP 2005/018417 filed on Oct. 5, 2005 which claims priority to Japanese patent application number 2004-295571 filed on Oct. 8, 2004, the entire disclosures of which are hereby incorporated by reference.--

Signed and Sealed this
Fifteenth Day of February, 2011

David J. Kappos

David J. Kappos
*Director of the United States Patent and Trademark Office*